US012642420B2

(12) United States Patent
Hwang et al.

(10) Patent No.: US 12,642,420 B2
(45) Date of Patent: Jun. 2, 2026

(54) DISHWASHER

(71) Applicant: LG ELECTRONICS INC., Seoul (KR)

(72) Inventors: Gyu Han Hwang, Seoul (KR); Seung Hun Kim, Seoul (KR); Byeong Hyeon Ju, Seoul (KR)

(73) Assignee: LG Electronics Inc., Seoul (KR)

( * ) Notice: Subject to any disclaimer, the term of this patent is extended or adjusted under 35 U.S.C. 154(b) by 94 days.

(21) Appl. No.: 18/631,183

(22) Filed: Apr. 10, 2024

(65) Prior Publication Data

US 2024/0341563 A1 Oct. 17, 2024

(30) Foreign Application Priority Data

Apr. 17, 2023 (KR) ..... 10-2023-0050082
Sep. 26, 2023 (KR) ..... 10-2023-0129608

(51) Int. Cl.
*A47L 15/48* (2006.01)

(52) U.S. Cl.
CPC ..... *A47L 15/481* (2013.01); *A47L 15/488* (2013.01); *A47L 2401/18* (2013.01); *A47L 2501/11* (2013.01)

(58) Field of Classification Search
CPC .. A47L 15/488; A47L 15/481; A47L 2501/11; A47L 2401/18
See application file for complete search history.

(56) References Cited

U.S. PATENT DOCUMENTS 7,846,270 B2 12/2010 Jerg et al.
8,293,024 B2 * 10/2012 Jerg ..... A47L 15/481 134/25.1
8,709,171 B2 4/2014 Jerg et al.
8,858,727 B2 10/2014 Jerg et al.
9,661,981 B2 5/2017 Classen et al.
9,854,957 B2 * 1/2018 Kumar ..... A47L 15/0002
2015/0216390 A1 * 8/2015 Kumar ..... A47L 15/4285 134/108
2016/0192821 A1 * 7/2016 Kumar ..... A47L 15/481 134/95.2

(Continued)

FOREIGN PATENT DOCUMENTS

DE 3626887 A1 * 2/1988 ..... D06F 58/24
DE 102005004096 A1 * 6/2006 ..... A47L 15/481

(Continued)

OTHER PUBLICATIONS

Machine Translation of DE 102012203320A1 to Ferber et al., Sep. 2013. (Year: 2013).*

(Continued)

*Primary Examiner* — Benjamin L Osterhout
(74) *Attorney, Agent, or Firm* — Fish & Richardson P.C.

(57) ABSTRACT

A dishwasher includes a sorption drying device in which a heater is disposed in a linear air flow path extending in a downward inclination angle, at least a portion of air that has passed through the linear air flow path collides with a bottom surface of a moisture absorbent receiving portion and thus is introduced to a lower side of the moisture absorbent, so that a separate means for flow distribution is omitted, and heated air through the heater is evenly introduced to the moisture absorbent at a minimized flow resistance.

20 Claims, 20 Drawing Sheets

(56) References Cited

U.S. PATENT DOCUMENTS

2017/0202423 A1* 7/2017 Kumar ..... A47L 15/0042

FOREIGN PATENT DOCUMENTS

| | | | | | |
|---|---|---|---|---|---|
| DE | 10-2012-203320 | A1 | | 9/2013 | |
| DE | 10-2015-211197 | A1 | | 12/2016 | |
| DE | 10-2015-211210 | A1 | | 12/2016 | |
| EP | 2682041 | A2 | * | 1/2014 | ..... A47L 15/4291 |
| EP | 4144279 | A1 | * | 3/2023 | ..... B01J 8/388 |
| KR | 20130087849 | A | * | 8/2013 | ..... A47L 15/486 |
| WO | WO-2008125517 | A1 | * | 10/2008 | ..... A47L 15/481 |
| WO | WO-2012084488 | A2 | * | 6/2012 | ..... A47L 15/481 |
| WO | WO-2013050541 | A1 | * | 4/2013 | ..... A47L 15/481 |
| WO | WO-2014056787 | A1 | * | 4/2014 | ..... A47L 15/481 |
| WO | WO-2015003933 | A1 | * | 1/2015 | ..... A47L 15/481 |
| WO | WO-2016072952 | A1 | * | 5/2016 | ..... A47L 15/483 |

OTHER PUBLICATIONS

Extended European Search Report in European Appln. No. 24169406.6, mailed on Sep. 20, 2024, 9 pages.

* cited by examiner

DISHWASHER

CROSS-REFERENCE TO RELATED APPLICATION

This application claims priority to and benefit of Korean Patent Application No. 10-2023-0050082, filed on Apr. 17, 2023, and No. 10-2023-0129608, filed on Sep. 26, 2023, which is hereby incorporated by reference as when fully set forth herein.

BACKGROUND

Field

The present disclosure relates to a dishwasher. More specifically, the present disclosure relates to a dishwasher including a sorption drying device in which a heater is disposed in a linear air flow path extending in a downward inclination angle, at least a portion of air that has passed through the linear air flow path collides with a bottom surface of a moisture absorbent receiving portion and thus is introduced to a lower side of the moisture absorbent, so that a separate means for flow distribution is omitted, and heated air through the heater is evenly introduced to the moisture absorbent at a minimized flow resistance.

Description of Related Art

A dishwasher is an apparatus that washes dishes and cooking utensils as washing targets stored therein by spraying washing water thereto. In this regard, the washing water may contain washing detergent.

A dishwasher generally includes a washing tub having a washing space defined therein, a dish rack that accommodates therein a washing target inside the washing tub, a spraying arm that sprays the washing water into the dish rack, and a sump that stores therein water and supplies the washing water to the spraying arm.

Using this dishwasher may allow a time and effort required to wash the dishes and other washing targets after a meal to be reduced, thereby contributing to user convenience.

Typically, the dishwasher is configured to perform a washing cycle for washing a washing target, a rinsing cycle for rinsing a washing target, and a drying cycle for drying a washing target that has been washed and rinsed.

Recently, a dishwasher equipped with a moisture-absorption device that may reduce a drying time of the washing target by absorbing water vapor contained in the air discharged from the tub during the drying cycle and then re-supplying the air to the tub has been released.

In this regard, in U.S. Pat. No. 8,858,727 (Prior Document 001), a dishwasher equipped with a moisture-absorption device which removes the water vapor contained in the air discharged from the tub during the drying process using a moisture absorbent, and supplies the air from which the water vapor has been removed back to the tub is disclosed.

The moisture-absorption device of the dishwasher disclosed in the prior document 001 is configured to dry and regenerate the moisture absorbent by supplying hot air to the moisture absorbent after the drying process has been completed using a heater disposed under the moisture absorbent.

However, the moisture-absorption device of the prior document 001 is configured so that the heater is disposed rightly under and very close to the moisture absorbent.

Therefore, there may be a problem that thermal damage and thermal deformation are likely to occur locally in a lower area of the moisture absorbent due to radiant heat of the heater.

Moreover, the moisture-absorption device of the prior document 001 is configured so that a tube-shaped heater is supported on a separate support plate in a state in which the heater extends and is bent in a direction intersecting a flow direction of air.

Therefore, when a flow rate of air is high, the heat transfer efficiency to air may decrease. Because at least a portion of the heater's heat is conducted to the plate, a problem may arise in that the thermal efficiency of the heater may deteriorate.

Moreover, the moisture-absorption device of the prior document 001 is configured so that a plurality of slots for distribution of the air heated by the heater are formed in the support plate.

Therefore, as the air flows through the narrow slot, flow resistance of the air increases. Thus, power consumption of a fan motor to generate an appropriate flow amount may increase.

Prior art literature: Patent Document 001: U.S. Pat. No. 8,858,727

SUMMARY

The present disclosure is designed to solve the problems of the prior art as described above. Thus, a first purpose of the present disclosure is to provide a dishwasher including a sorption drying device in which a heater extends and is bent so that a longitudinal direction of the heater is parallel to a flow direction of the air, thereby preventing decrease in heat transfer efficiency of the heater to the air, and improving heating efficiency of the heater.

Moreover, a second purpose of the present disclosure is to provide a dishwasher including a sorption drying device in which the heater is positioned in a location where radiant heat of the heater does not directly act on the moisture absorbent, thereby minimizing thermal deformation and heat damage to the moisture absorbent caused by the conductive heat of the heater.

Moreover, a third purpose of the present disclosure is to provide a dishwasher including a sorption drying device in which the heater is disposed in a linear air flow path extending in a downward inclination angle, and at least a portion of the air that has passed through the linear air flow path collides with a bottom surface of a moisture absorbent receiving portion and thus is introduced into a lower side of the moisture absorbent, so that a separate slot plate for flow distribution as used in the prior art may be omitted, and the heated air through the heart is evenly introduced into the moisture absorbent at a minimized flow resistance.

Moreover, a fourth purpose of the present disclosure is to provide a dishwasher including a sorption drying device in which a moisture absorbent supporter supporting a bottom of the moisture absorbent thereon is disposed in the moisture absorbent receiving portion so as to have a crossing angle with respect to the bottom surface of the moisture absorbent receiving portion, thereby maximizing an introduction area of the air toward the moisture absorbent, and maintaining a drying efficiency and a regeneration efficiency of the moisture absorbent at a maximum level.

Purposes of the present disclosure are not limited to the above-mentioned purpose. Other purposes and advantages of the present disclosure that are not mentioned may be understood based on following descriptions, and may be more clearly understood based on embodiments of the present disclosure. Further, it will be easily understood that the purposes and advantages of the present disclosure may be realized using means shown in the claims and combinations thereof.

A first aspect of the present disclosure provides a dishwasher comprising: a tub having a washing space defined therein and constructed to accommodate therein a dish; and a sorption drying device configured to absorb moisture from air discharged from the tub and supply the moisture-free air to the tub, wherein the sorption drying device includes: a blow fan configured to generate flow of the air; a moisture absorbent disposed downstream of the blow fan in a flow direction of the air flow; a heater disposed between the blow fan and the moisture absorbent in the flow direction of the air flow, wherein the heater is configured to heat the air flow to be supplied to the moisture absorbent; a heater receiving portion having a first inlet into which the air flow having passed through the blow fan flows and a first outlet which the flow is discharged out of, wherein the heater receiving portion has a heater receiving space defined therein for accommodating the heater therein; and a moisture absorbent receiving portion having a moisture absorbent receiving space defined therein, wherein the air flow having passed through the heater receiving portion flows in the moisture absorbent receiving space, and the moisture absorbent is received in the moisture absorbent receiving space, wherein the moisture absorbent receiving portion further has an air introduction space defined therein, wherein the air introduction space is positioned upstream of the moisture absorbent receiving space in the flow direction of the air flow, wherein the air flow having passed through the heater receiving space is introduced into the air introduction space, wherein the heater receiving space extends linearly toward the air introduction space.

In one embodiment of the first aspect, the moisture absorbent receiving space has a second inlet through which air having passed through the first outlet flows into the air introduction space, wherein the heater receiving space and the air introduction space constitute a first flow channel in which air to be supplied to the moisture absorbent flows in a state in which the first outlet and the second inlet are in communication with each other, wherein the heater receiving space extends in a downward inclination such that a vertical dimension of the heater receiving space based on a bottom surface of the air introduction space gradually decreases as the heater receiving space extends toward the first outlet.

In one embodiment of the first aspect, a first crossing angle is defined between a bottom surface of the heater receiving space and the bottom surface of the air introduction space or between a top surface of the heater receiving space and the bottom surface of the air introduction space.

In one embodiment of the first aspect, the first crossing angle is smaller than or equal to 45 degrees.

In one embodiment of the first aspect, a vertical dimension between the bottom surface of the air introduction space and a top surface of the air introduction space gradually decreases as the air introduction space extends away from the second inlet.

In one embodiment of the first aspect, the dishwasher further comprises a first moisture absorbent holder disposed in an inner space of the moisture absorbent receiving portion, and constructed to divide the inner space of the moisture absorbent receiving portion into the moisture absorbent receiving space and the air introduction space, wherein a lower surface of the first moisture absorbent holder acts as the top surface of the air introduction space.

In one embodiment of the first aspect, the first moisture absorbent holder has a first holding surface defining a second crossing angle relative to the bottom surface of the air introduction space.

In one embodiment of the first aspect, the second crossing angle is equal to the first crossing angle.

In one embodiment of the first aspect, the first moisture absorbent holder has a second holding surface continuously extending from the first holding surface, wherein a third crossing angle is defined between the second holding surface and the bottom surface of the air introduction space.

In one embodiment of the first aspect, the third crossing angle is smaller than the second crossing angle.

In one embodiment of the first aspect, the dishwasher further comprises a second moisture absorbent holder disposed in the inner space of the moisture absorbent receiving portion and spaced upwardly from the first moisture absorbent holder, wherein the moisture absorbent receiving space is defined between the first moisture absorbent holder and the second moisture absorbent holder.

In one embodiment of the first aspect, the second moisture absorbent holder is parallel to the bottom surface of the air introduction space.

In one embodiment of the first aspect, a second flow channel is defined between the first moisture absorbent holder and the second moisture absorbent holder, wherein air whose a flow direction has been changed in the air introduction space flows in and along the second flow channel, wherein a vertical dimension of the second flow channel gradually increases as the second flow channel extends away from the second inlet.

In one embodiment of the first aspect, the blow fan is connected to one end of the heater receiving portion, wherein the moisture absorbent receiving portion is connected to the other end of the heater receiving portion, wherein the heater is disposed between the one end and the other end of the heater receiving portion.

In one embodiment of the first aspect, the heater includes a portion extending in a direction parallel to a longitudinal direction of the heater receiving space, wherein the longitudinal direction of the heater receiving space is a direction between a center of the first inlet and a center of the first outlet.

In one embodiment of the first aspect, the heater is disposed closer to the other end of the heater receiving portion than to one end of the heater receiving portion.

In one embodiment of the first aspect, the dishwasher further comprises a heater housing for accommodating the heater therein, wherein the heater housing is disposed in the heater receiving space, wherein the heater receiving space is positioned in an inner space of the heater housing.

In one embodiment of the first aspect, the heater housing is disposed in an inner space of the heater receiving portion so that a longitudinal direction of the heater housing is parallel to a longitudinal direction of the heater receiving portion.

A second aspect of the present disclosure provides a dishwasher comprising: a tub having a washing space defined therein and constructed to accommodate therein a dish; and a sorption drying device configured to absorb moisture from air discharged from the tub and supply the moisture-free air to the tub, wherein the sorption drying device includes: a blow fan configured to generate flow of the air; a moisture absorbent disposed downstream of the blow fan in a flow direction of the air flow; a heater disposed between the blow fan and the moisture absorbent in the flow direction of the air flow, wherein the heater is configured to heat the air flow to be supplied to the moisture absorbent; a heater receiving portion having a heater receiving space defined therein for receiving the heater therein, wherein the air flow having passed through the blow fan flows through the heater receiving portion; and a moisture absorbent receiving portion having a moisture absorbent receiving space defined therein for receiving therein the moisture absorbent, wherein the air flow having passed through the heater receiving portion flows through the moisture absorbent receiving portion, wherein in a plan view of the dishwasher, the heater and the moisture absorbent nonoverlap each other, and are spaced from each other such that the heater and the moisture absorbent respectively have portions having the same vertical level based on a bottom surface of the moisture absorbent receiving portion.

In one embodiment of the second aspect, a first crossing angle is defined between a bottom surface of the heater receiving space and the bottom surface of the moisture absorbent receiving portion or between a top surface of the heater receiving space and the bottom surface of the moisture absorbent receiving portion.

The dishwasher according to the present disclosure includes the sorption drying device in which the heater extends and is bent so that a longitudinal direction of the heater is parallel to a flow direction of the air, thereby preventing decrease in heat transfer efficiency of the heater to the air, and improving heating efficiency of the heater.

Moreover, the dishwasher according to the present disclosure includes the sorption drying device in which the heater is positioned in a location where radiant heat of the heater does not directly act on the moisture absorbent, thereby minimizing thermal deformation and heat damage to the moisture absorbent caused by the conductive heat of the heater.

Moreover, the dishwasher according to the present disclosure includes the sorption drying device in which the heater is disposed in a linear air flow path extending in a downward inclination angle, and at least a portion of the air that has passed through the linear air flow path collides with a bottom surface of a moisture absorbent receiving portion and thus is introduced into a lower side of the moisture absorbent, so that a separate slot plate for flow distribution as used in the prior art may be omitted, and the heated air through the heart is evenly introduced into the moisture absorbent at a minimized flow resistance.

Moreover, the dishwasher according to the present disclosure includes the sorption drying device in which a moisture absorbent supporter supporting a bottom of the moisture absorbent thereon is disposed in the moisture absorbent receiving portion so as to have a crossing angle with respect to the bottom surface of the moisture absorbent receiving portion, thereby maximizing an introduction area of the air toward the moisture absorbent, and maintaining a drying efficiency and a regeneration efficiency of the moisture absorbent at a maximum level.

In addition to the above-mentioned effects, the specific effects of the present disclosure as not mentioned will be described below along with the descriptions of the specific details for carrying out the present disclosure.

DETAILED DESCRIPTIONS

Figure 1:
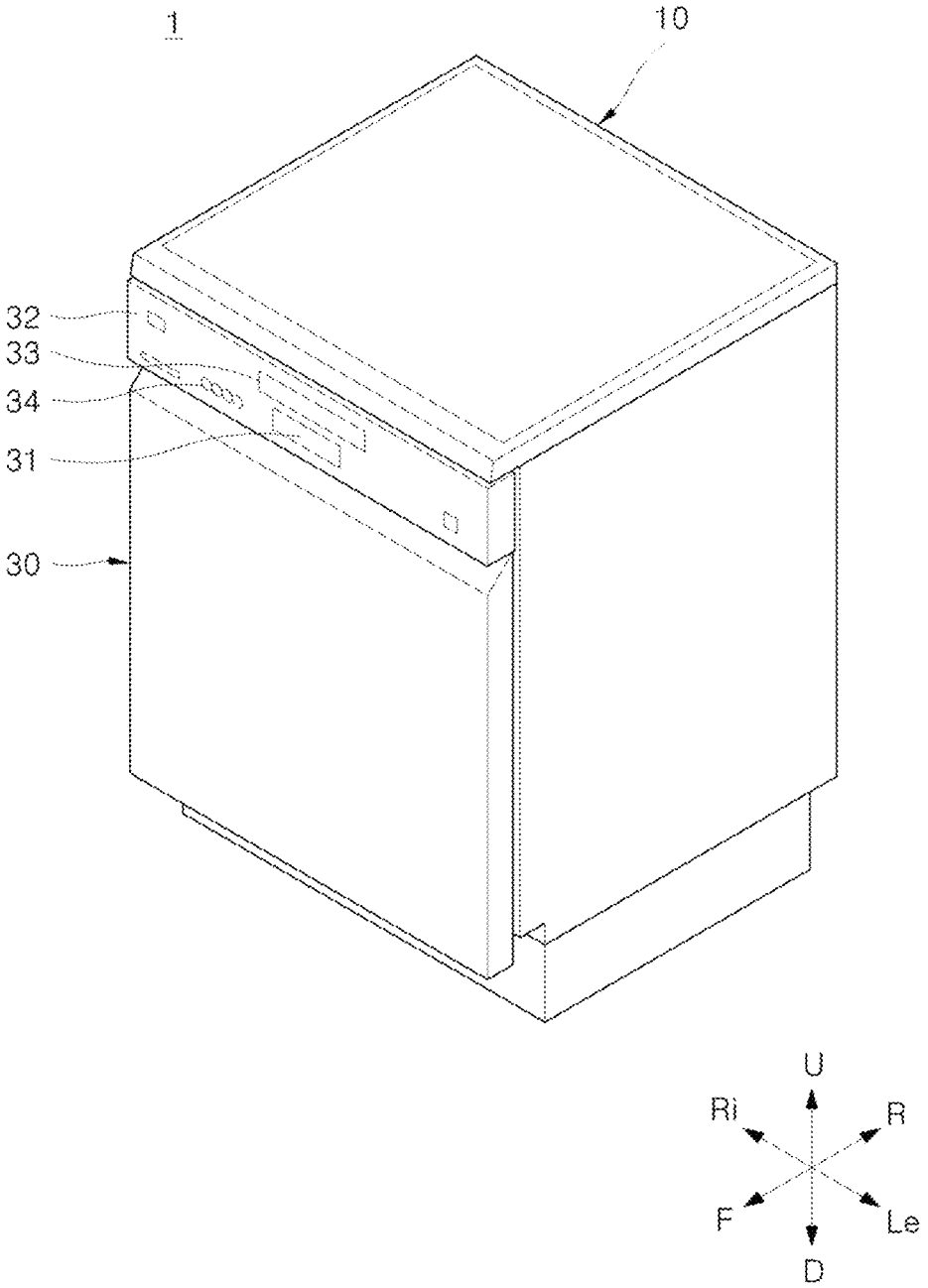
FIG. 1 is a front perspective view of a dishwasher according to one embodiment of the present disclosure.

The above-mentioned purpose, features and advantages are described in detail below with reference to the attached drawings. Accordingly, a person skilled in the art in the technical field to which the present disclosure belongs will be able to easily implement the technical idea of the present disclosure. In describing the present disclosure, when it is determined that a detailed description of the known technology related to the present disclosure may unnecessarily obscure the gist of the present disclosure, the detailed description thereof is omitted. Hereinafter, preferred embodiments according to the present disclosure will be described in detail with reference to the attached drawings. In the drawings, identical reference numerals are used to indicate identical or similar components.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

The terminology used herein is directed to the purpose of describing particular embodiments only and is not intended to be limiting of the present disclosure. As used herein, the singular constitutes "a" and "an" are intended to include the plural constitutes as well, unless the context clearly indicates otherwise.

It will also be understood that when a first element or layer is referred to as being present "on" a second element or layer, the first element may be disposed directly on the second element or may be disposed indirectly on the second element with a third element or layer being disposed between the first and second elements or layers. It will also be understood that when a first element or layer is referred to as being present "under" a second element or layer, the first element may be disposed directly under the second element or may be disposed indirectly under the second element with a third element or layer being disposed between the first and second elements or layers.

It will be understood that when an element or layer is referred to as being "connected to", or "coupled to" another element or layer, it may be directly connected to or coupled to another element or layer, or one or more intervening elements or layers therebetween may be present. In addition, it will also be understood that when an element or layer is referred to as being "between" two elements or layers, it may be the only element or layer between the two elements or layers, or one or more intervening elements or layers therebetween may also be present.

It will be further understood that the terms "comprise", "comprising", "include", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of associated listed items. Expression such as "at least one of" when preceding a list of elements may modify the entire list of elements and may not modify the individual elements of the list. In interpretation of numerical values, an error or tolerance therein may occur even when there is no explicit description thereof.

Spatially relative terms, such as "beneath," "below," "lower," "under," "above," "upper," and the like, may be used herein for ease of explanation to describe one element or feature's relationship to another element or feature as illustrated in the figures. It will be understood that the spatially relative terms are intended to encompass different orientations of the device in use or in operation, in addition to the orientation depicted in the figures. For example, when the device in the drawings may be turned over, elements described as "below" or "beneath" or "under" other elements or features would then be oriented "above" the other elements or features. Thus, the example terms "below" and "under" may encompass both an orientation of above and below. The device may be otherwise oriented for example, rotated 90 degrees or at other orientations, and the spatially relative descriptors used herein should be interpreted accordingly.

As used herein, "A and/or B" means A, B or A and B, unless specifically stated otherwise. Expression such as "at least one of" when preceding a list of elements may modify the entirety of list of elements and may not modify the individual elements of the list. As used herein, "C to D" means C inclusive to D inclusive unless otherwise specified.

Hereinafter, the present disclosure will be described with reference to drawings showing a configuration according to an embodiment of the present disclosure.

Overall Structure of Dishwasher

Hereinafter, an overall structure of a dishwasher 1 according to an embodiment of the present disclosure will be described in detail with reference to the attached drawings.

Figure 2:
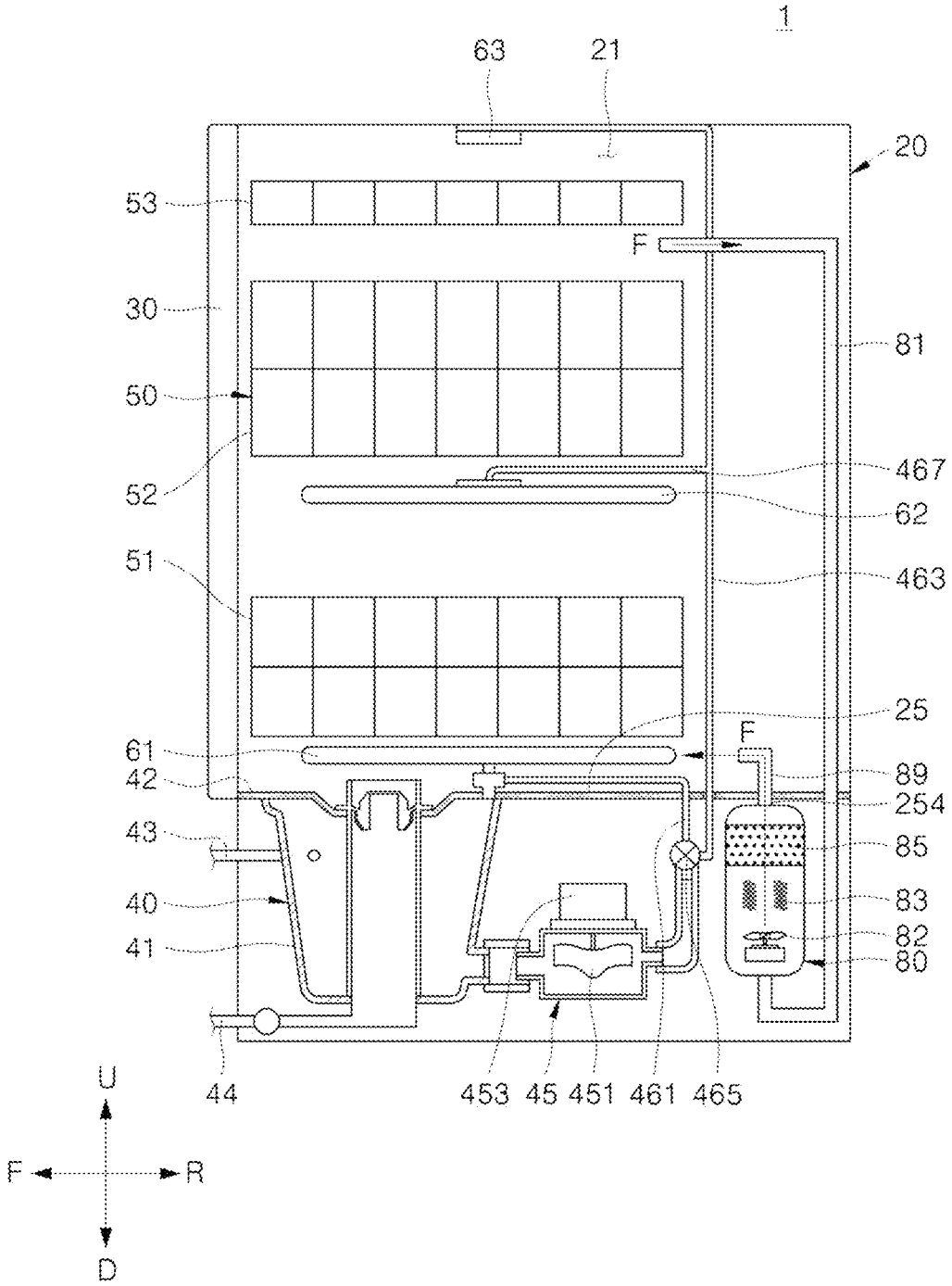
FIG. 2 is a schematic cross-sectional view of the dishwasher as shown in FIG. 1.
Figure 3:
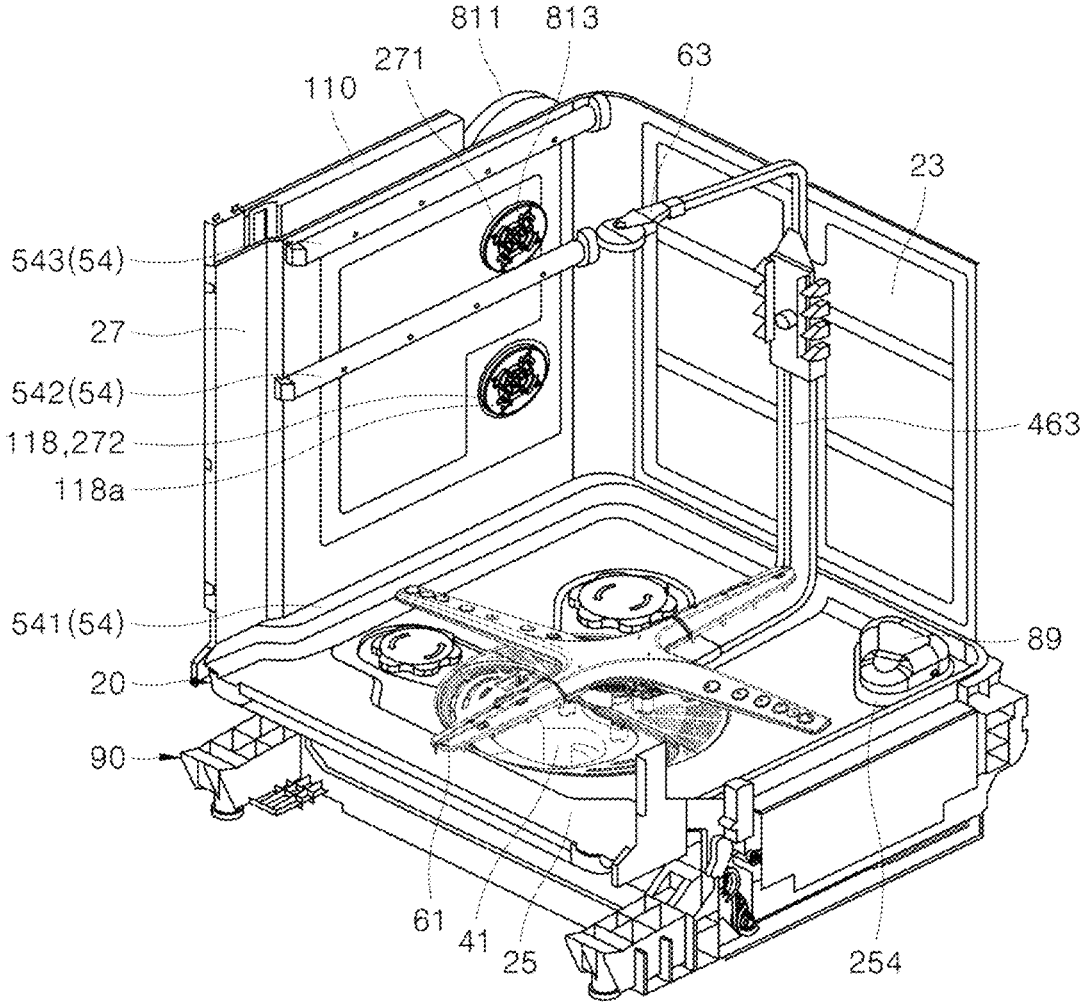
FIG. 3 is a front perspective view showing a state in which a door of the dishwasher as shown in FIG. 1 is opened.

FIG. 1 is a front perspective view showing the dishwasher according to the present disclosure. FIG. 2 is a simplified cross-sectional view briefly showing an internal structure of the dishwasher according to the present disclosure. FIG. 3 is a front perspective view showing a state in which a door 30 of the dishwasher 1 as shown in FIG. 1 is in an open state.

As shown in FIG. 1 to FIG. 3, the dishwasher 1 according to the present disclosure may include a casing 10 that constitutes an exterior appearance, a tub 20 installed in an inner space of the casing 10 and having a washing space 21 defined therein where the washing target is washed, wherein a front surface of the tub is open, a door 30 that opens/closes the open front surface of the tub 20, a driver 40 located under the tub 20 to supply, collect, circulate, and discharge the washing water for washing the washing target, a dish rack 50 removably provided in the inner washing space 21 of the tub 20 to receive therein the washing target, and a water sprayer 60 installed adjacent to the dish rack 50 to spray the washing water for washing the washing target thereto.

In this regard, the washing target received in the dish rack 50 may be, for example, dishes such as bowls, plates, spoons, and chopsticks, and other cooking utensils. Hereinafter, unless otherwise specified, the washing target will be referred to as a dish.

The tub 20 may be formed in a box shape with an entirely open front surface, and have a configuration of a so-called washing tub.

The washing space 21 may be defined inside the tub 20. The open front surface of the tub 20 may be opened/closing by the door 30.

The tub 20 may be formed via pressing of a metal plate resistant to high temperature and moisture, for example, a stainless steel plate.

Moreover, on an inner surface of the tub 20, a plurality of brackets may be disposed for the purpose of supporting and installing functional components such as the dish rack 50 and the water sprayer 60 which will be described later thereon within the tub 20.

In one example, the driver 40 may include a sump 41 that stores therein washing water, a sump cover 42 that distinguishes the sump 41 from the tub 20, a water supply 43 that supplies washing water from an external source to the sump 41, a water discharger 44 that discharges the washing water of the sump 41 to an outside, and a washing pump 45 and a supply flow path 46 that supply the washing water of the sump 41 to the water sprayer 60.

The sump cover 42 may be disposed at a top of the sump 41 and may serve to distinguish the tub 20 and the sump 41 from each other. Moreover, the sump cover 42 may have a plurality of collecting holes defined therein for collecting washing water sprayed into the washing space 21 through the water sprayer 60 into the sump 41.

That is, the washing water sprayed from the water sprayer 60 toward the dish may fall down to a bottom of the washing space 21, and may be collected again through the sump cover 42 and into the sump 41.

The washing pump 45 may be disposed at a side or a bottom of the sump 41 and may serve to pressurize the washing water and supply the pressurized washing water to the water sprayer 60.

One end of the washing pump 45 may be connected to the sump 41 and the other end thereof may be connected to the supply flow path 46. The washing pump 45 may be equipped with an impeller 451 and a motor 453. When power is supplied to the motor 453, the impeller 451 may rotate, and thus the washing water in the sump 41 may be pressurized, and then may be supplied to the water sprayer 60 through the supply flow path 46.

In one example, the supply flow path 46 may serve to selectively supply the washing water supplied from the washing pump 45 to the water sprayer 60.

For example, the supply flow path 46 may include a first supply flow path 461 connected to a lower spraying arm 61, and a second supply flow path 463 connected to an upper spraying arm 62 and a top nozzle 63. The supply flow path 46 may be provided with a supply flow path switching valve 465 that selectively opens/closes the supply flow paths 461 and 463.

In this regard, the supply flow path switching valve 465 may be controlled so that the supply flow paths 461 and 463 are opened sequentially or simultaneously.

In one example, the water sprayer 60 may be constructed to spray the washing water to the dishes stored in the dish rack 50.

More specifically, the water sprayer 60 may include the lower spraying arm 61 located under the tub 20 to spray the washing water to a lower rack 51, the upper spraying arm 62 located between the lower rack 51 and an upper rack 52 to spray the washing water to the lower rack 51 and the upper rack 52, and the top nozzle 63 located on top of the tub 20 to spray the washing water to a top rack 53 or the upper rack 52.

In particular, the lower spraying arm 61 and the upper spraying arm 62 may be rotatably disposed in the washing space 21 of the tub 20 and may spray the washing water toward the dish of the dish rack 50 while being rotating.

The lower spraying arm 61 may be rotatably supported on a top of the sump cover 42 so as to spray the washing water toward the lower rack 51 while being rotating and being disposed under the lower rack 51.

Moreover, the upper spraying arm 62 may be rotatably supported by a spraying arm holder 467 so as to spray the washing water on the dish while being rotating and being disposed between the lower rack 51 and the upper rack 52.

In one example, although not shown, in order to increase washing efficiency, additional means for diverting the washing water sprayed from the lower spraying arm 61 into an upward direction (diverting in a U-direction) may be provided at a lower surface 25 of the tub 20.

Since a configuration already known in the art may be applied to a detailed configuration of the water sprayer 60, description of a specific configuration of the water sprayer 60 will be omitted below.

The dish rack 50 for storing the dish therein may be disposed in the washing space 21.

The dish rack 50 may be constructed to extend or retract from or into the inner space of the tub 20 through the open front surface of the tub 20.

For example, in FIG. 2, an embodiment is shown in which the dish rack 50 includes the lower rack 51 located at a lower portion of the tub 20 to accommodate therein relatively large dishes, the upper rack 5 located on top of the lower rack 51 to accommodate therein medium-sized dishes, and the top rack 53 located at a top level of the tub 20 and capable of storing therein small dishes, etc. However, the present disclosure is not limited thereto. However, hereinafter, an example in which the dishwasher includes the three dish racks 50 as shown is described.

Each of the lower rack 51, the upper rack 52, and the top rack 53 may be constructed to extend or retract from or into the inner space of the tub 20 through the open front surface of the tub 20.

For this purpose, guide rails 54 may be respectively disposed on both opposing walls constituting an inner surface of the tub 20. By way of example, the guide rails 54 may include an upper rail, a lower rail, and a top rail.

Wheels may be disposed on a bottom of each of the lower rack 51, the upper rack 52, and the top rack 53. The user may extend the lower rack 51, the upper rack 52, and the top rack 53 from the inner space of the tub 20 through the open front surface of the tub 20 and may place the dishes thereon, or easily withdraw the dishes that have been washed out thereof.

The guide rail 54 may be embodied as a simple rail-type fixed guide rail to guide the extending or the retracting of the rack 50, or a telescopic guide rail capable of guiding the extending or the retracting of the rack 50 and at the same time, increasing an extension distance thereof as the rack 50 further extends from the inner space of the tub.

In one example, the door 30 is configured for opening/closing the open front surface of the tub 20 as described above.

A hinge (not shown) around which the door 30 is closed or opened may be provided at a bottom of the open front surface. Thus, the door 30 may pivot around the hinge as a pivot axis.

In this regard, a handle 31 for opening the door 30 and a control panel 32 for controlling the dishwasher 1 may be disposed on an outer side surface of the door 30.

As shown, the control panel 32 may include a display 33 that visually displays information regarding a current operating status of the dishwasher, etc., and a button unit 34 including a selection button through which a user's selection manipulation is input and a power button through which a user's manipulation for turning the dishwasher on and off is input.

In one example, an inner side surface of the door 30 may constitute one side surface of the tub 20 when the door 30 has been closed, and may constitute a seat surface on which the lower rack 51 of the dish rack 50 is supported when the door 30 is fully opened.

For this purpose, when the door 30 is fully opened downwardly, the inner side surface of the door 30 may constitute a horizontal plane extending in the same direction as a direction in which the guide rail 54 guiding the displacement of the lower rack 51 extends.

In one example, a washing detergent supply device to automatically supply washing detergent to the inner space of the tub 20 may be disposed on the inner side surface of the door 30.

In one example, under the tub 20, a sorption drying device 80 may be disposed which absorbs water vapor contained in the air discharged from the tub 20 during the drying cycle and then re-supplies the air back to the tub 20. The Sorption drying device may also be referred to similar terms such as moisture-absorption device, adsorption device, and sorption device.

As shown, the sorption drying device 80 may be configured to include an air intake duct 81 through which the air discharged from the tub 20 is sucked, a blower 82 that generates a flow of air, a heating unit 83 that heats the air sucked from the tub 20 and a moisture absorbent 85 that absorbs the water vapor contained in the air.

As described later, the lower surface 25 of the tub 20 may have an air supply hole 254 through which the air from which the water vapor has been removed using the sorption drying device 80 is introduced into the inner space of the tub 20.

Moreover, as shown in FIG. 3, a grill cap 8113 coupled to an inlet of the air intake duct 81 may be fixed to one side surface of the tub 20, for example, to a right side surface thereof.

A detailed configuration of the sorption drying device 80 will be described later with reference to FIG. 3 below.

Detailed Composition of Sorption Drying Device

Hereinafter, with reference to FIG. 3 to FIG. 13, the detailed configuration of the sorption drying device 80 according to an embodiment of the present disclosure is described.

First, as shown in FIGS. 3 to 6, remaining parts of the sorption drying device 80 excluding a main duct 811 of the air intake duct 81 and a discharge guide 89 may be disposed to be accommodated between a base 90 and the lower surface 25 of the tub 20 and may be supported on a lower surface 91 of the base 90.

For example, the blower 82, the heater 83, and the housing 84 of the sorption drying device 80 may be disposed adjacent to a rear surface 93 of the base 90, and may be arranged in a parallel manner to a length of the rear surface 93 of the base 90.

A position of the sorption drying device 80 may be selected in consideration of characteristics of the heating unit 83 of the sorption drying device 80 which generates high heat of approximately 200° C. or higher in a moisture absorbent drying mode. In other words, the position of the sorption drying device 80 may be selected as a position other than positions of electrical components that are relatively affected by the high heat.

In this way, the blower 82, the heater 83, and the housing 84 of the sorption drying device 80 may be adjacent to the rear surface 93 of the base 90 and may be arranged in a parallel manner to a length of the rear surface 93 of the base 90. Thus, when the door 30 is fully opened downwardly, a weight balance state may be achieved to prevent the dishwasher 1 from tilting due to a load of the door 30.

Figure 4:
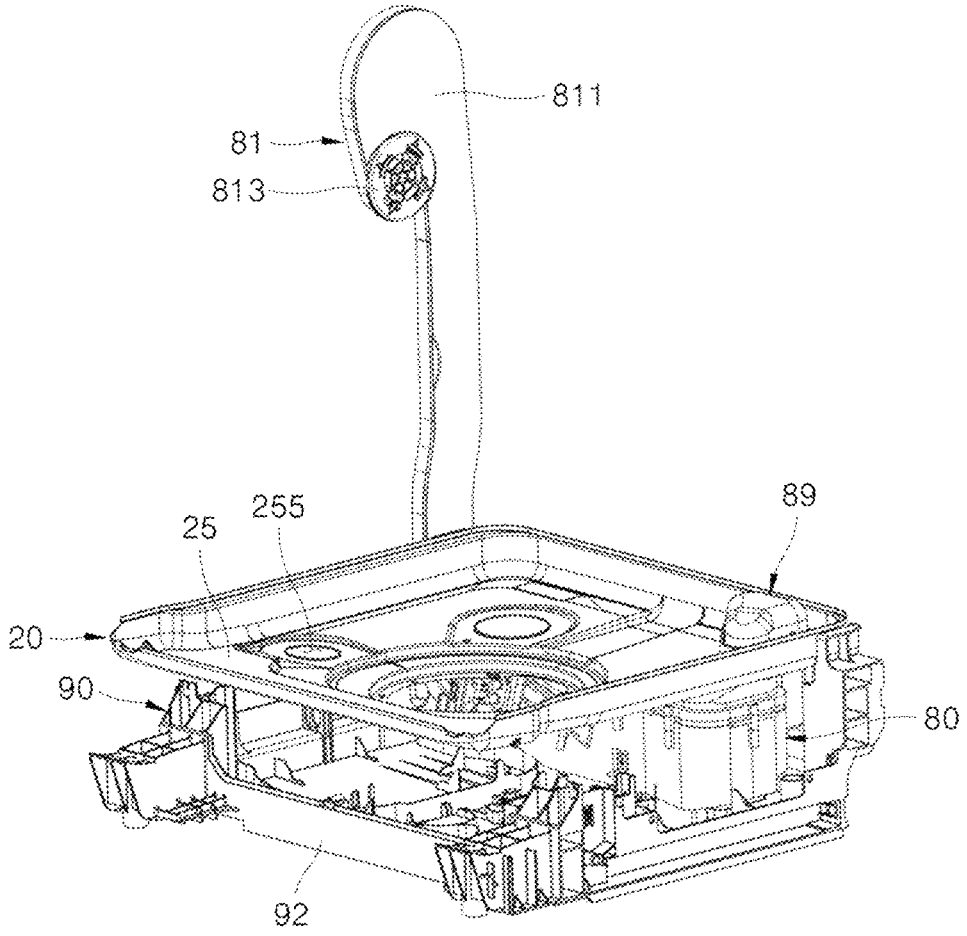
FIG. 4 is a front perspective view showing a state in which a sorption drying device of the dishwasher according to an embodiment of the present disclosure is accommodated in a base.
Figure 5:
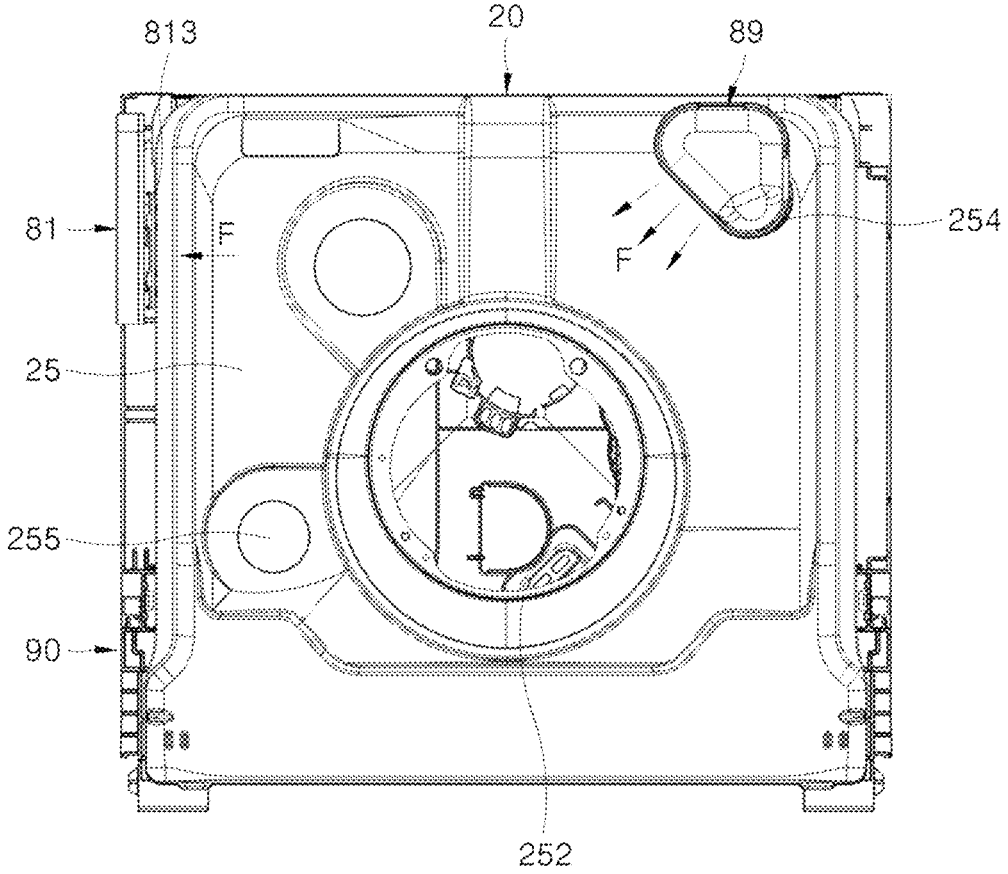
FIG. 5 is a plan view of FIG. 4.
Figure 6:
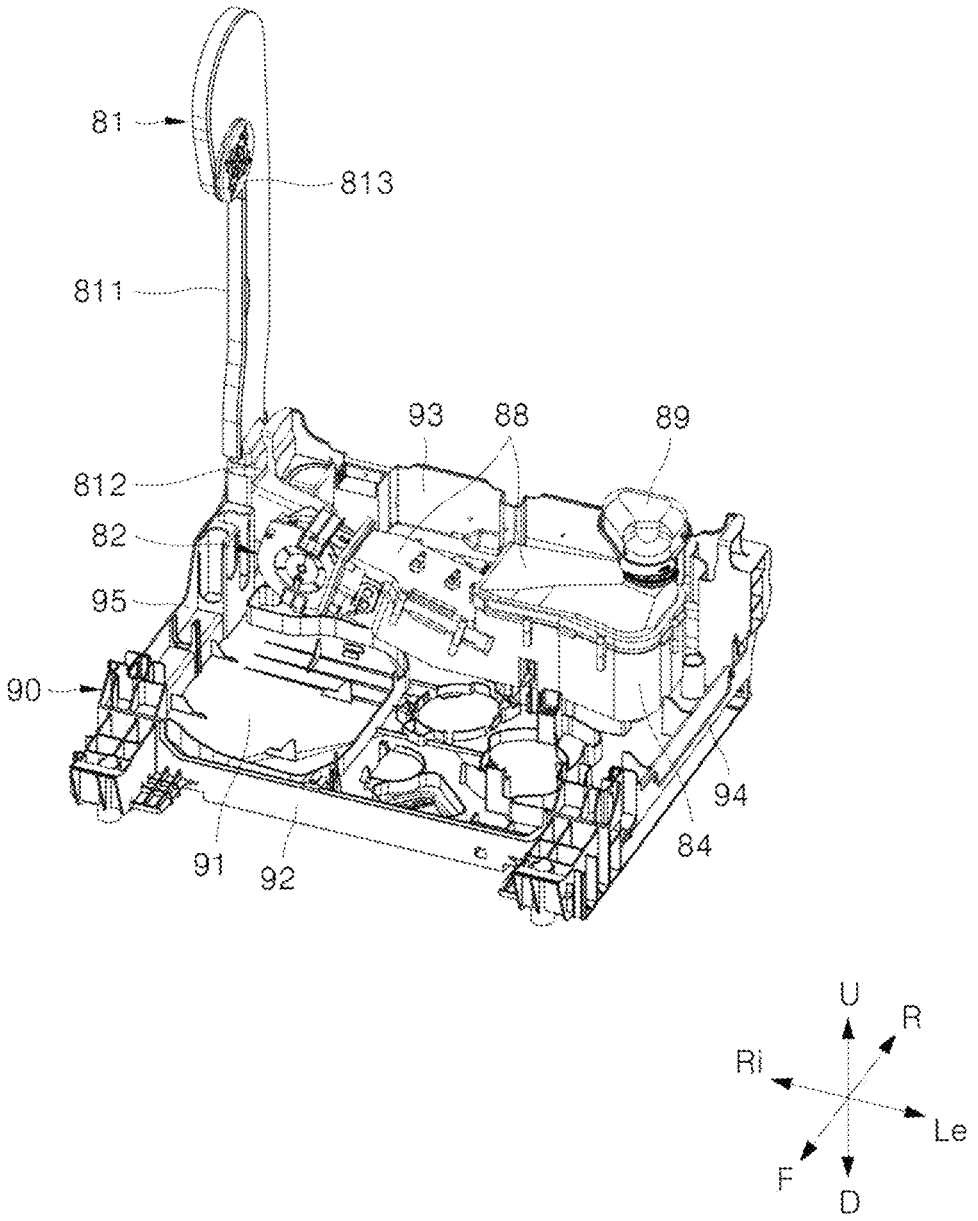
FIG. 6 is a front perspective view showing a state in which a tub has been removed in FIG. 4.

Moreover, as shown in FIGS. 3 to 5, the position of the device 80 may be selected based on a location of the air supply hole 254 formed in the lower surface 25 of the tub 20. In consideration of user safety and in order to distinguish the air supply hole 254 from the water softener communication hole 255 located close to the front surface of the tub 20, the air supply hole 254 through which dry air is discharged may be formed in the lower surface 25 of the tub 20 and adjacent to a corner at which a rear surface and a left side surface meet each other.

The air supplied through the air supply hole 254 may be evenly distributed to the washing space 21 of the tub 20 through the discharge guide 89 exposed to the washing space 21.

In order to effectively supply the air from which the moisture has been absorbed to the air supply hole 254 formed at this location, the housing 84 of the sorption drying device 80 that accommodates therein the moisture absorbent 85 may be disposed close to the air supply hole 254 and under the air supply hole 254.

However, the position of the sorption drying device 80 is only an example. The present disclosure is not limited thereto. Alternatively, the sorption drying device 80 may be located adjacent to a left side surface 94, a right side surface 95, or a front surface 92 rather than the rear surface 93 of the base 90. The present disclosure is not limited thereto. Hereinafter, the description will be based on an embodiment in which the sorption drying device 80 is disposed adjacent to the rear surface 93 of the base 90 and extends in a parallel manner to the length of the rear surface 93 of the base 90.

In one example, as shown in FIG. 3 to FIG. 6, the blower 82, the heater 83, and housing 84 of the sorption drying device 80 may be disposed adjacent to the rear surface 93 of the base 90 and may be arranged in a parallel manner to the length of the rear surface 93 of the base 90. The air supply hole 254 may be formed adjacent to a corner at which the rear surface and the left side surface meet each other and in the lower surface 25 of the tub 20. In this case, an air intake hole 271 through which humid air is discharged from the tub 20 may be defined in a right side surface of the tub 20 and adjacent to a corner where the right side surface and the rear surface meet each other, and may be formed at a position close to an upper surface 24 of the tub 20.

The location of this air intake hole 271 may be selected as a location spaced as far as possible from the air supply hole 254 formed in the lower surface 25 of the tub 20.

In this way, the air intake hole 271 may be positioned so as to be as far as possible from the air supply hole 254 and the discharge guide 89. Thus, a possibility at which the air that has passed through the air supply hole 254 and the discharge guide 89 re-flows directly into the air intake hole 271 without passing through the washing target may be significantly reduced.

Moreover, the air intake hole 271 may be located at a higher position in a vertical direction than that of the upper rail 542 constituting the guide rail 54, for example, may be positioned between the top rail 543 and the upper rail 542.

Therefore, the air intake hole 271 may be formed at a higher position in the vertical direction than that of the upper rack 52 mounted on the upper rail 542 and moving along the upper rail 542. Thus, air flow Fin the washing space 21 may be guided such that the air evenly flows through the lower rack 51 and the upper rack 52 and then flows into the air intake hole 271.

Moreover, as shown in FIG. 3, the air intake hole 271 together with the main duct 811 which will be described later may be located in rear of a water jacket 110 where the washing water to be supplied to the sump 41 where the washing water is stored is stored.

In this regard, as shown, a tub hole 118 may be formed in the water jacket 110 to communicate an internal space of the water jacket with the washing space 21 of the tub 20. A water jacket communication hole 272 may be defined in the right side surface 27 of the tub 20 in a corresponding manner to the tub hole 118.

The air intake hole 271 may be defined at a position other than a position of the water jacket 110 and may be formed at a higher position than that of the water jacket communication hole 272.

As shown, a grill cap 118*a* similar in shape to the grill cap 813 of the air intake hole 271 as described above may be coupled to the tub hole 118 to minimize inflow of the washing water and prevent inflow of foreign substances.

In one example, the grill cap 813 may be coupled to the air intake hole 271. Thus, the grill cap 813 may allow the washing water and foreign substances scattered from the inner space of the tub 20 from inflowing into the air intake duct 81 at a minimized level.

As will be described later, the grill cap 813 may pass through the air intake hole 271 and be coupled to an inlet 811*a* of the main duct 811 constituting the air intake duct 81.

FIGS. 7 to 13 show a detailed configuration of the sorption drying device 80.

As shown, the sorption drying device 80 may be configured include the blower 82 that generates flow F of air sucked from the tub 20 and to be supplied to the inner space of the tub 20, the heating unit 83 including the heater 831 that heats air to be supplied to the absorbent 85, a plurality of moisture absorbents 85 disposed downstream of the blower 82 and the heating unit 83 in a flow direction of air and absorb moisture contained in the air, the housing 84 having a heater receiving space S1 in which the heating unit 83 is accommodated and a moisture absorbent receiving space S3 in which the moisture absorbent 85 is accommodated, the air intake duct 81 connecting the air intake hole of the tub 20 and the blower 82 to each other, and the discharge guide 89 guiding a direction in which the air exposed to the inner space of the tub 20 and flowing through the moisture absorbent 85 is discharged.

The blower 82 may be disposed upstream of the heating unit 83 and the moisture absorbent 85 in the flow direction of the air flow F, and may be disposed downstream of the air intake duct 81 in the flow direction of the air flow F and may suck the air from the tub 20, and may generate the air flow F so that the sucked air may pass through the moisture absorbent 85.

A blow fan (not shown) and a blower motor (not shown) that generates a rotational driving force of the blow fan may be modularized together to form an assembly accommodated inside a fan housing 821.

The fan housing 821 may be fixed to a main housing 841 which will be described later via a connecting bracket 822.

Figure 9:
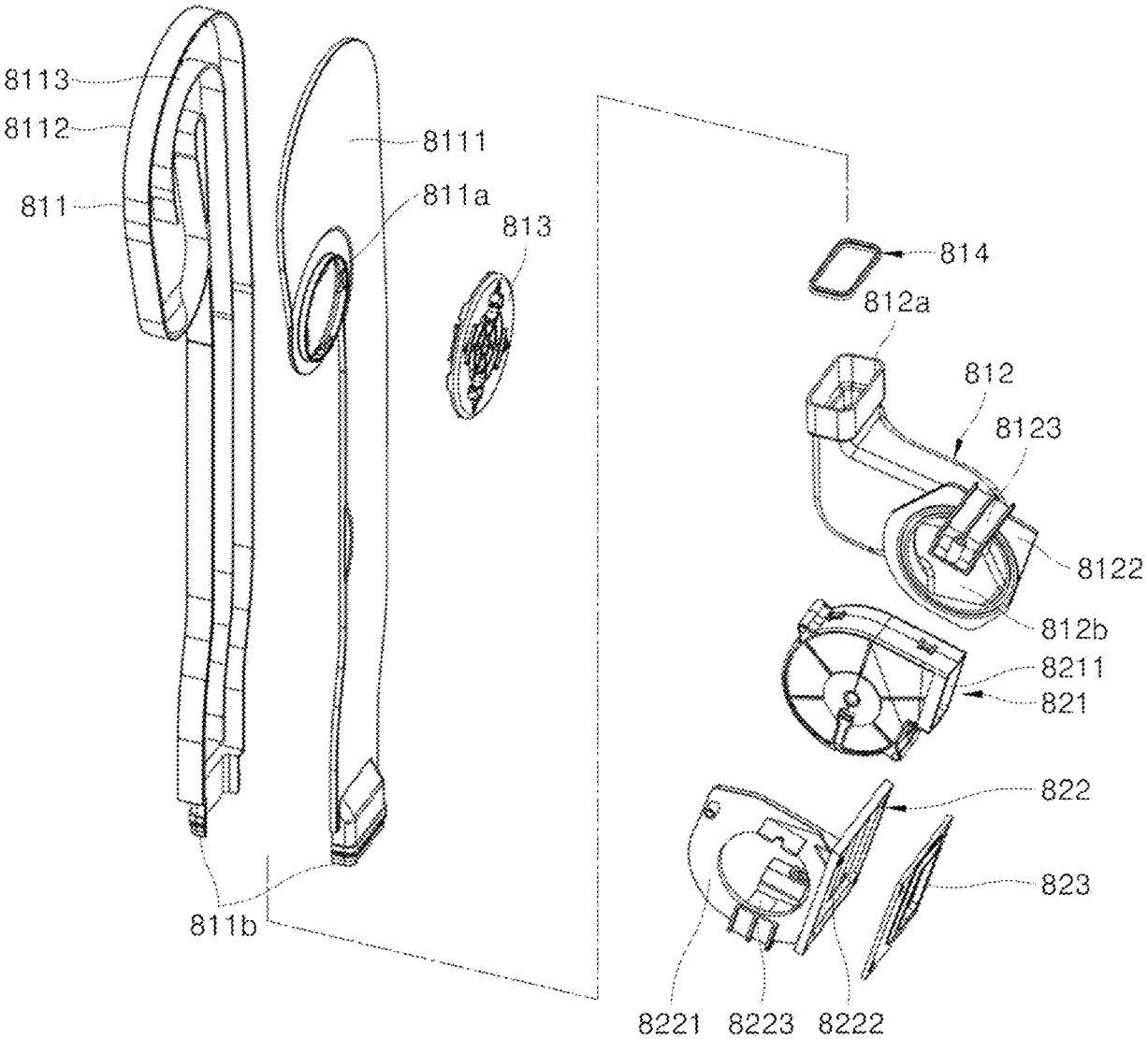
FIG. 9 is an exploded perspective view of an air intake duct and a blower of the sorption drying device as shown in FIG. 7.

As shown in FIG. 9, the connecting bracket 822 may include a fan connector 8221 in a shape of a circular plate coupled to one side surface of the fan housing 821, a rectangle plate-shaped housing connector 8222 coupled to an inlet IN1 of the main housing 841, and a bridge 8223 having one end fixed to the fan connector 8221, and extending in a bar shape and having the other end fixed to the other side surface of the fan housing 821.

The fan connector 8221 may be provided in a circular plate shape corresponding to a shape of one side surface of the fan housing 821, and may be fastened to the fan housing 821 using fastening means such as a screw bolt while being in surface contact with one side surface of the fan housing 821.

The housing connector 8222 may extend substantially perpendicular to the extension direction of the fan connector 8221 and may be integrally connected to an outer edge of the fan connector 8221. Therefore, the housing connector 8222 and the fan connector 8221 may be coupled to each other to achieve an overall L-shape.

The housing connector 8222 may be provided in the shape of a rectangle plate with taking into account a shape of a front end of the main housing 841 where the inlet IN1 is formed, that is, a shape of a front end of a heater receiving portion 8411 of the main housing 841, as described later. The housing connector 8222 may be fastened to the front end of the heater receiving portion 8411 of the main housing 841 using fastening means such as a screw bolt.

Moreover, a rectangle hole may extend through the housing connector 8222 and may have a shape corresponding to a shape of a discharge hole 8211 of the fan housing 821 and a shape of the inlet IN1 of the heater receiving portion 8411 of the main housing 841.

The discharge hole 8211 of the fan housing 821 may extend through the rectangle hole formed in the housing connector 8222 and extend into the inlet IN1 of the main housing 841.

The bridge 8223 may have one end integrally connected to the fan connector 8221 and extend along a rotation axis of the blow fan and have the other end connected to the other side surface of the fan housing 821. In the other end of the bridge 8223, a fastening hole may be formed through which fastening means such as a screw bolt may pass. Therefore, a rigid fastening structure may be achieved in which the connecting bracket 822 is fastened to the other side surface of the fan housing 821 via the bridge 8223.

In one example, an auxiliary duct 812 constituting the air intake duct 81 may be coupled and fastened to the other side surface of the fan housing 821 where an intake hole is formed.

Moreover, as shown in FIG. 9, between the housing connector 8222 of the connecting bracket 822 and the front end of the heater receiving portion 8411 of the main housing 841, a gasket 823 which has a rectangle plate shape and is made of an elastic material may be disposed.

There is no limitation on a type of the blow fan applied to the sorption drying device 80. However, in one example, a sirocco fan is preferable in consideration of constraints in terms of a position and a space where the blow fan is installed.

In the illustrated embodiment, when the sirocco fan is applied, air guided through the auxiliary duct 812 of the intake duct 81 may be introduced through the other side surface of the fan housing 821, that is, a rear surface thereof into the fan in a direction parallel to a rotation axis from a center of the sirocco fan, and then, the air may be accelerated radially and outwardly, and then may be discharged through the discharge hole 8211.

The accelerated and discharged air may generate the air flow F and may flow through the inlet IN1 of the heater receiving portion 8411 of the main housing 841 and be introduced into the inner space of the heater housing 832, which will be described later.

As will be described later, the heater receiving portion 8411 may extend in a downward inclination in which a vertical dimension thereof gradually decreases as the heater receiving portion 8411 extends from a front end to a rear end thereof.

In this regard, the blower 82 is fastened to the front end of the heater receiving portion 8411 via the connecting bracket 822. Therefore, the discharge hole of the fan housing 821 and the inlet IN1 of the heater receiving portion 8411 may be located at a higher vertical level that a vertical level of a bottom surface 8412*a* of the moisture absorbent receiving portion 8412 formed at the lowest position in the inner space of the main housing 841, and may be disposed at a position that is further apart from the moisture absorbent 85 as described later in a length direction thereof. Because, in this way, the blower 82 is disposed at the higher vertical level than that of the bottom surface 8412*a* of the moisture absorbent receiving portion 8412, a center of gravity of the sorption drying device 80 may be distributed along a vertical direction, such that vibration and noise generation may be minimized. Moreover, because the moisture absorbent 85 present in a form of particles may be disposed at a lower vertical level and be disposed as close to the bottom surface

8412*a* of the moisture absorbent receiving portion 8412 as possible, the vibration and noise generation may be reduced.

Moreover, an area occupied by the blower 82 may overlap an area occupied by the moisture absorbent 85 and the moisture absorbent receiving space S3 which will be described later in the vertical direction.

Therefore, the blower 82 and the moisture absorbent 85 which have a relatively large weight may be disposed in a distributed manner along a longitudinal direction of the heater receiving portion 8411. A difference between vertical levels of the blower 82 and the moisture absorbent 85 may be minimized.

Accordingly, an attenuation effect of the vibration generated by the blower 82 and the vibration generated by other components of the dishwasher 1 may be improved.

Moreover, as will be described later, the blower 82 is disposed at a higher vertical level than that of the bottom surface 8412*a* of the moisture absorbent receiving portion 8412 which constitutes a lower end of the internal space formed by the moisture absorbent receiving portion 8412 and the heater receiving portion 8411. Thus, influence due to condensation of the moisture contained in the air flow F may be minimized.

The heating unit 83 may be disposed between the blower 82 and the moisture absorbent 85 as described above in the flow direction of the air flow F, and may play a role in heating the air flow F to dry and regenerate the moisture absorbent 85 in the moisture absorbent drying mode.

When the sorption drying device 80 generates a high temperature air flow F in the moisture absorbent drying mode, power may be supplied to the heater 831 to heat the air flow F. When the sorption drying device 80 generates a low-temperature air flow F in the moisture-absorption mode, the power supplied to the heater 831 may be cut off such that an operation of the heater 831 may be stopped.

In this regard, when the low-temperature air flow F is generated in the moisture-absorption mode, an operation of the blower motor may be maintained.

There is no limitation on the type of the heater 831 provided in the sorption drying device 80 according to an embodiment of the present disclosure. For example, a tube-shaped sheath heater that has a relatively simple structure, has excellent heat generation efficiency, and is advantageous in preventing electric leakage due to the washing water flowing from the tub 20 may be selected.

In order to increase the heat exchange efficiency, a heater body 8311 as the sheath heater may be directly exposed to the flow F of the air in an inner air passage of the heater housing 832, and may be bent multiple times to maximize a heat transfer area.

Figure 13:
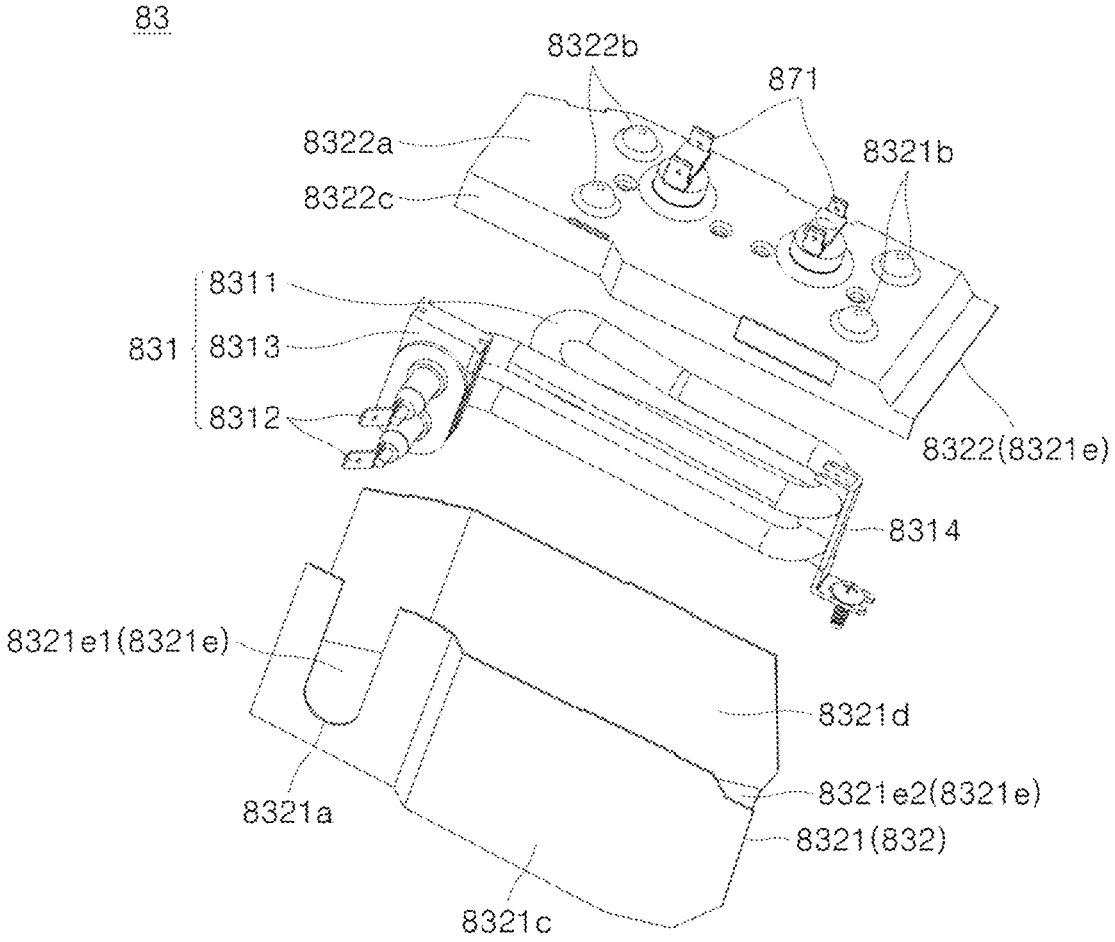
FIG. 13 is an exploded perspective view of the heater as shown in FIG. 12.

FIG. 13 shows an example in which the heater body 8311 extends in a U-shape, that is, is bent twice by 90 degrees to form two rows. The present disclosure is not limited thereto. However, following description will be based on a configuration in which the heater body 8311 extends into two rows.

The heater body 8311 may extend between the inlet IN1 formed at one end, i.e., the front end of the heater receiving portion 8411 of the main housing 841 and an outlet OUT1 formed at the other end, i.e., the rear end of the heater receiving portion 8411 thereof.

In this regard, the heater body 8311 may be disposed in the heater receiving portion 8411 such that a longitudinal direction thereof is parallel to a longitudinal direction of the heater receiving space S1 and the heater housing 832.

Thus, the heat exchange performance and heat exchange efficiency of the heater body 8311 may be improved compared to a case where the longitudinal direction of the heater body 8311 intersects the longitudinal direction of the heater receiving space S1.

In this regard, as will be described later, for smooth drying and regeneration of the moisture absorbent 85 accommodated in the moisture absorbent receiving portion 8412, an extension length of the heater body 8311 needs to be secured as much as possible. For example, the extension length of the heater body 8311 may be greater than or equal to 70% of a length of the moisture absorbent receiving portion 8412.

However, as described later, the heater body 8311 may be closer to the outlet OUT1 formed at the rear end of the heater receiving portion 8411 than to the inlet IN1 formed at the front end of the heater receiving portion 8411, and thus may be disposed in the heater receiving portion 8411 of the housing 841.

That is, a spacing between the front end of the heater body 8311 and the inlet IN1 of the heater receiving portion 8411 may be larger than a spacing between the rear end of the heater body 8311 and the outlet OUT1 of the heater receiving portion 8411.

Thus, the heater body 8311 may be disposed at a position spaced as far away from the blower 82 as possible. Thus, a possibility of damage to the blow fan and the blower motor of the blower 82 due to radiant heat from the heater body 8311 may be minimized.

The heater body 8311 may extend such that one end and the other end thereof extend through the front surface of the heater housing 832 and the front surface of the heater receiving portion 8411 of the main housing 841.

Moreover, a pair of terminals 8312 to receive power may be formed respectively at one end and the other end of the heater body 8311.

As shown, the pair of terminals 8312 may be fixedly installed onto the heater receiving portion 8411 of the main housing 841 via a terminal fixing portion 8313.

In this regard, a front surface of the heater receiving portion 8411 may have a fixing slot 8411*c*1 defined therein so that the terminal fixing portion 8313 may be fitted thereto in a sliding manner.

A slit-shaped groove extending in a sliding direction, that is, an up-down direction (U-D direction) may be formed on each of both opposing side surfaces of the terminal fixing portion 8313. While the terminal fixing portion 8313 slides upwardly, an edge of the fixing slot 8411*c*1 may be inserted into the slit-shaped groove and fitted thereto.

In this way, a front end of the heater body 8311 may be fixed to and supported on the terminal fixing portion 8313.

A rear end of the heater body 8311 may be fixed and supported to a single heater racket 8314, as shown in FIG. 13. That is, the rear end of the heater body 8311 may be supported on an air passage while being separated from the heater housing 832 and the heater receiving portion 8411 of the main housing 841 via the tub racket 8314.

The heater tub racket 8314 may be made of a metal material in consideration of a function of the heater body 8311 which generates high temperature heat, and may be preferably made of a metal plate that is resistant to high temperature and moisture. For example, the heater tub racket 8314 may be manufactured by pressing a plate made of a stainless steel-based material.

For example, the tub racket 8314 may be manufactured to have an L-shape as shown in FIG. 13.

As shown in the illustrated embodiment, a vertical extension extending in the vertical direction (U-D direction) of the L shape structure may have two heater holders forcibly coupled to an outer surface of the heater body 8311 in a corresponding manner to the two rows of the heater body 8311 to effectively support the heater body 8311 extending in the two rows.

The heater holder may include a pair of heater holders which may be spaced apart from each other in the vertical direction and may be formed at the vertical extension in a corresponding manner to the two rows of the heater body 8311 which are spaced apart from each other along the vertical direction (U-D direction). Each heater holder may be constructed to have a C-shape corresponding to a shape of the tube-shaped heater body 8311.

Each heater holder may be forcibly coupled to the outer surface of the heater body 8311 in a plastically deformed manner when being coupled to the heater body 8311. Each heater holder may be forcibly coupled to the heater body 8311 and modularized therewith before being fixed to the bottom surface 8412*a* of the moisture absorbent receiving portion 8412 constituting the main housing 841.

A horizontal extension extending approximately along a left-right direction (Le-Ri direction) of the L-shape structure may be formed integrally with a lower end of the vertical extension.

The horizontal extension may directly contact the bottom surface 8412*a* of the moisture absorbent receiving portion 8412 of the main housing 841 and may serve to support the heater body 8311 and the vertical extension. The horizontal extension may be constructed to be fixed to the bottom surface 8412*a* of the moisture absorbent receiving portion 8412 via fastening means such as a screw bolt.

Figure 15:
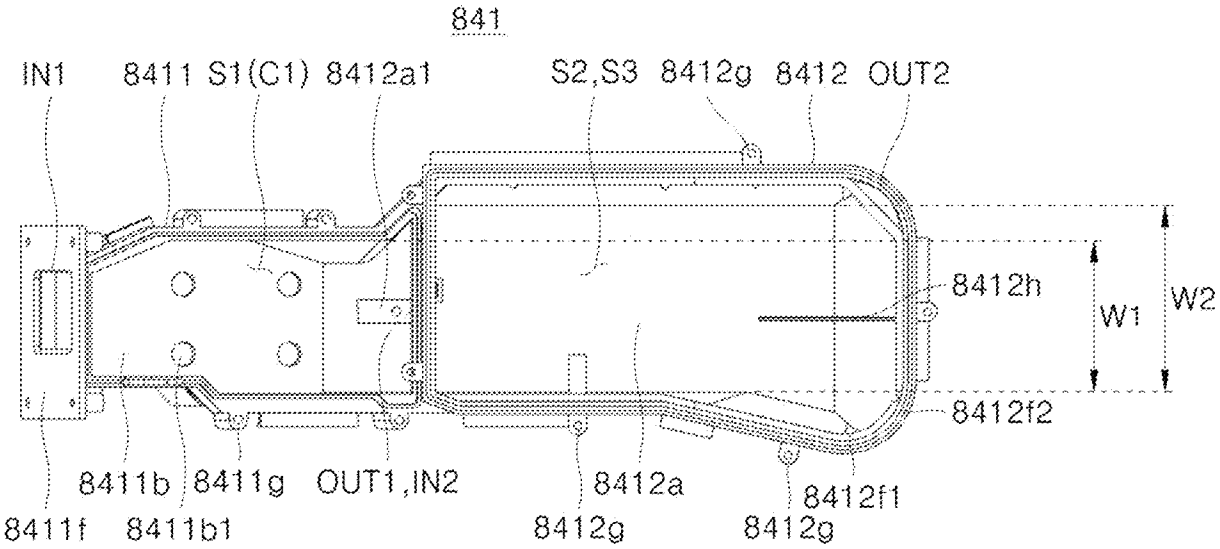

As shown in FIG. 15, a coupling groove 8412*a*1 may be formed concavely in the bottom surface 8412*a* of the moisture absorbent receiving portion 8412 to guide a fastening position of the horizontal extension.

In one example, the heater housing 832 may be formed in a hollow form with an empty inner space to define an air passage in which the heater body 8311 is disposed. The air passage defined in the heater housing 832 together with an air introduction space S2 formed in a lower portion of the moisture absorbent receiving portion 8412 may constitute a first flow channel C1.

As described above, the heater body 8311 may be disposed in an inner space of the heater housing 832 so that a longitudinal direction thereof is parallel to the flow direction of the air flow F. Accordingly, like the heater body 8311, the heater housing 832 may be disposed in the heater receiving space S1 of the heater receiving portion 8411 of the main housing 841 so that a longitudinal direction thereof is parallel to the flow direction of the air flow F.

In this regard, in a corresponding manner to a shape of the heater receiving space S1, the heater housing 832 may extend linearly toward the air introduction space S2 along the longitudinal direction of the heater receiving portion 8411.

However, a length of the heater housing 832 may be greater than a length of the heater body 8311 so as to accommodate an entirety of the heater body 8311 therein.

In this regard, each of the front end of the heater housing 832 corresponding to a upstream side and the rear end thereof corresponding to a downstream side in the flow direction of the air flow F may be entirely opened so that the air may flow therethrough.

In this way, in order that each of the front end and the rear end may have the open air passage defined therein in an easy manner, the heater housing 832 may be divided into a lower housing 8321 and an upper housing 8322 arranged in the up-down direction (U-D) direction.

However, the present disclosure is not limited thereto. Hereinafter, as shown in FIG. 13, the description will be based on an embodiment in which the heater housing 832 is divided into the lower housing 8321 and the upper housing 8322 arranged in the up-down direction (U-D) direction.

The lower housing 8321 which constitutes a divided lower portion of the heater housing 832 constitutes a front surface, a rear surface, and a lower surface of the heater housing 832 in the illustrated state.

A passage slot 8321*a* may be formed in a U shape in a front surface 8321*c* of the lower housing 8321 so that the terminal 8312 of the heater body 8311 as described above may pass therethrough in a frontward direction.

A lower surface 8321*e* of the lower housing 8321 which constitutes a lower end surface of the inner air passage may approximately parallel to a bottom surface 8411*b* of the heater receiving portion 8411 of the main housing 841 which will be described later. As described later, the bottom face 8411*b* of the heater receiving portion 8411 may extend parallel to a longitudinal direction of the heater receiving portion 8411. Thus, similarly, the lower surface 8321*e* of the lower housing 8321 may extend parallel to the longitudinal direction of the heater receiving portion 8411.

In this regard, a front edge of the lower surface 8321*e* of the lower housing 8321 may extend toward a lower end of the inlet IN1 of the heater receiving portion 8411, while a rear edge of the lower surface 8321*e* of the lower housing 8321 may extend toward the outlet OUT1 of the heater receiving portion 8411.

In this regard, the rear edge of the lower surface 8321*e* of the lower housing 8321 may extend to a position beyond a front end of the bottom surface 8412*a* of the moisture absorbent receiving portion 8412.

As will be described later, the front end of the bottom surface 8412*a* of the moisture absorbent receiving portion 8412 may extend to an inner space of the heater receiving portion 8411.

Therefore, the lower surface 8321*e* of the lower housing 8321 may have a bent shape corresponding to a shape of a corner at which the rear end of the bottom surface 8411*b* of the heater receiving portion 8411 and the front end of the bottom surface 8412*a* of the moisture absorbent receiving portion 8412 meet each other.

More specifically, the lower surface 8321*e* of the lower housing 8321 may be configured to include a first surface 8321*e*1 extending linearly from the front edge to the lower end edge thereof so as to define a first crossing angle a1 with respect to the bottom surface 8412*a* of the moisture absorbent receiving portion 8412, and a second surface 8321*e*2 that is bent from the first surface 8321*e*1 and extends parallel to the bottom surface 8412*a* of the moisture absorbent receiving portion 8412.

As will be described later, the first crossing angle a1 may be in a range of 20 to 25 degrees. Hereinafter, the crossing angle is defined to mean a smaller angle among an angle defined between extension lines of two straight lines or an angle defined between extension surfaces of two planes.

Therefore, an extension direction of a bottom surface of the first flow channel C1 formed in an inner space of the heater housing 832 may be diverted at a position at which the second surface 8321*e*2 of the lower surface 8321*e* of the lower housing 8321 is bent from the first surface 8321*e*1.

In one example, the lower housing 8321 provides an air passage with a flow path area larger than a cross-sectional area of the inlet IN1 of the heater receiving portion 8411.

To this end, as shown in FIG. 13, the front end of the lower housing 8321 may include an expansion section whose a cross-sectional area gradually increases in a front-rear direction while extending along the flow direction of the air flow F.

Duc to the expansion section, the flow rate of the air flow F may be reduced while the air flow F flows through the inlet IN1 of the heater receiving portion 8411, such that the heat exchange efficiency between the heater body 8311 and the air flow F may be improved.

Moreover, a plurality of first bead forming portions (8321*b* in FIG. 13) that is concave downwardly may be formed in the lower surface 8321*e* of the lower housing 8321.

Using the first bead forming portion 8321*b*, a isolation space with a predefined spacing may be formed between the bottom surface 8411*b* of the heater receiving portion 8411 and the first surface 8321*e*1 of the lower surface 8321*e* of the lower housing 8321 and between the bottom surface 8412*a* of the moisture absorbent receiving portion 8412 and the second surface 8321*e*2 of the lower surface 8321*e* of the lower housing 8321. This isolation space may act as a thermally insulating air layer for the lower housing 8321.

In one example, the upper housing 8322 is coupled to the open upper surface of the lower housing 8321, and serves to define a top surface of the inner air passage by closing the upper surface of the lower housing 8321.

To this end, an upper surface 8322*a* of the upper housing 8322 may be formed to have a corresponding size to a size of the open upper surface of the lower housing 8321. Moreover, the upper surface 8322*a* of the upper housing 8322 may be approximately parallel to an upper surface 8411*a* of the heater receiving portion 8411 of the main housing 841, which will be described later.

A front edge of the upper surface 8322*a* of the upper housing 8322 may extend toward an upper end of the inlet IN1 of the heater receiving portion 8411, while a rear edge of the upper surface 8322*a* of the upper housing 8322 may extend toward the outlet OUT1 of the heater receiving portion 8411.

In this regard, the rear edge of the upper surface 8322*a* of the upper housing 8322 may extend to an upper end of the outlet OUT1 of the heater receiving portion 8411.

Moreover, like the lower housing 8321, the upper surface 8322*a* of the upper housing 8322 may extend linearly from the front edge to the lower end edge thereof so as to define the first crossing angle a1 relative to the bottom surface 8412*a* of the moisture absorbent receiving portion 8412.

Accordingly, a top surface of the first flow channel C1 defined in an inner space of the heater housing 832 may extend linearly to the outlet OUT1 of the heater receiving portion 8411.

Moreover, a coupling surface 8322*c* bent downwardly may be formed at each of the front edge and the rear edge of the upper surface of the upper housing 8322.

When the upper housing 8322 and the lower housing 8321 are coupled to each other, these coupling surfaces 8322*c* may be in surface contact with a front surface 8321*c* and a rear surface 8321*d* of the lower housing 8321, respectively.

Thus, coupling and connection strength between the lower housing 8321 and the upper housing 8322 may be improved.

In one example, as shown in FIG. 13, a thermostat 871 constituting a temperature sensing unit 87 may be disposed on the upper surface 8322*a* of the upper housing 8322. The thermostat 871 may detect whether the heater body 8311 is overheated.

For example, the thermostat 871 may be provided as a pair of thermostats, and the pair of thermostats 871 may be arranged in a longitudinal direction of the heater body 8311 so as to effectively detect local overheating of the heater body 8311.

Figure 10:
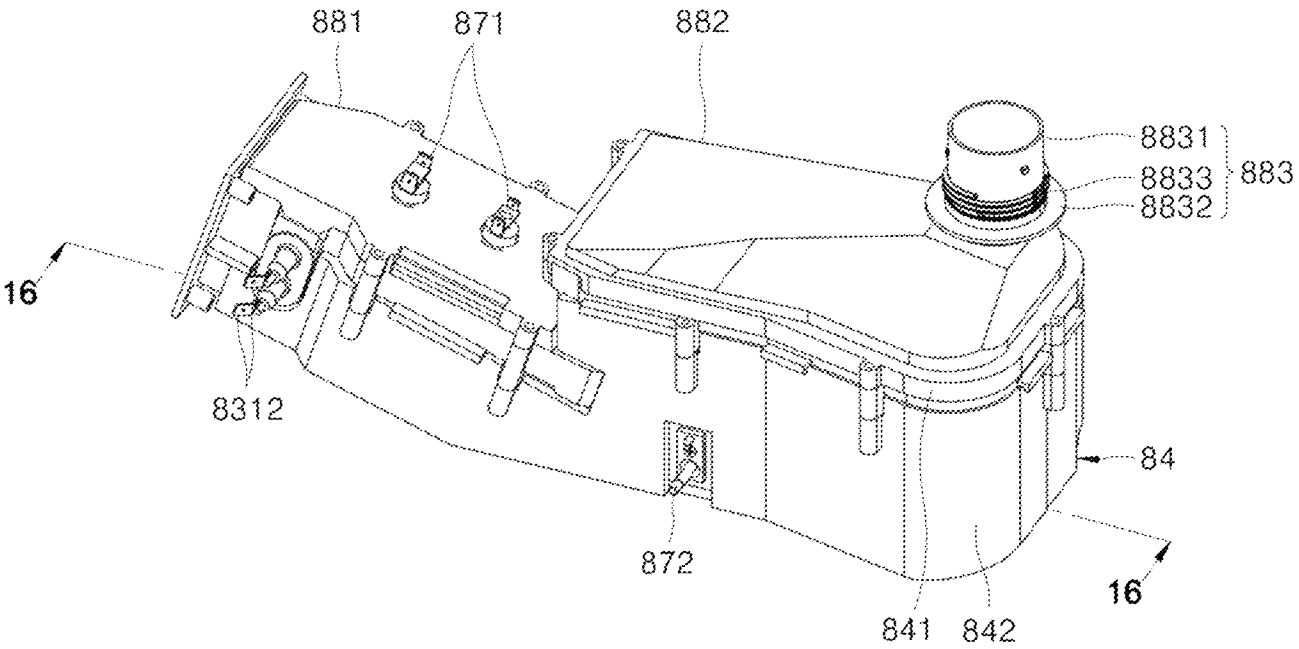
FIG. 10 and FIG. 11 are front perspective views showing a combined state of a heater, a housing, and a cover of the sorption drying device as shown in FIG. 7.
Figure 11:
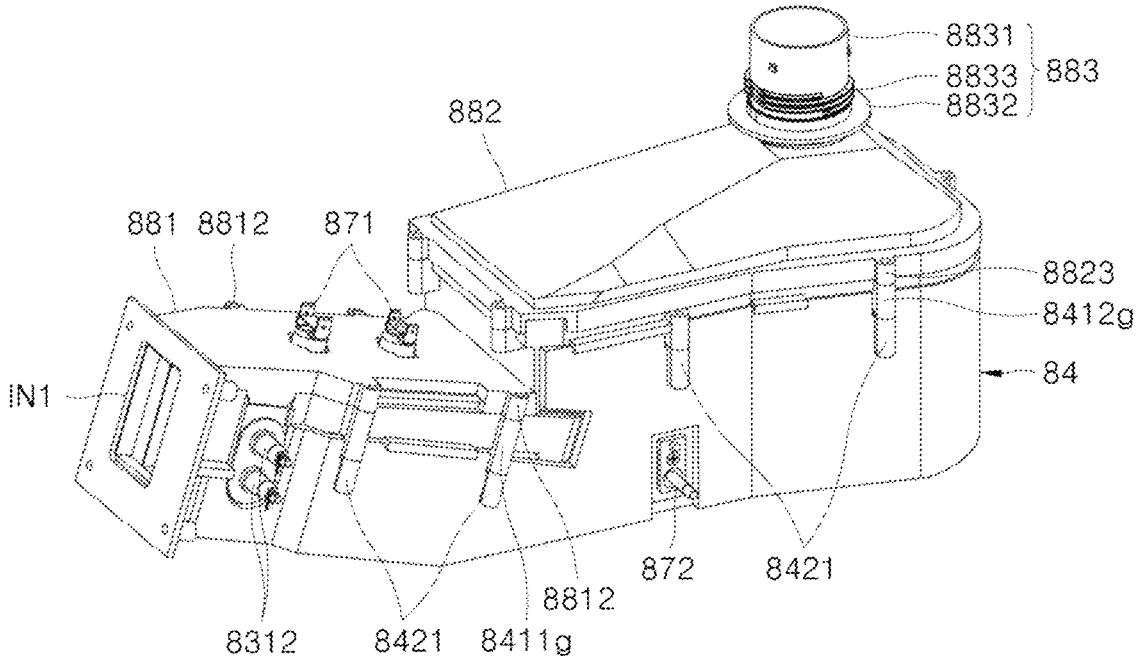

In one example, the temperature sensing unit 87 may further include a thermistor 872 that detects a temperature of the air flow F. Unlike the thermostat 871, the thermistor 872 serves to detect the temperature of the air flow F having passed through the heater body 8311. To this end, as shown in FIG. 10 and FIG. 11, in order to minimize the influence of the radiant heat from the heater body 8311, the thermistor 872 may extend through the front surface 8412*b*1 of the moisture absorbent receiving portion 8412 and a front surface of an auxiliary housing 842 which are located downstream of the heater body 8311 and the air introduction space S2, which will be described later. In this way, the thermistor 872 may extend into the inner space of the moisture absorbent receiving portion 8412 positioned between the heater body 8311 and the moisture absorbent 85 in the flow direction of the air flow so that the thermistor 872 may detect the temperature of the air flow F having passed through the heater body 8311. The thermistor 872 may identify whether the flow F of an appropriate temperature is being supplied to the moisture absorbent 85 during an operation of the sorption drying device 80.

An output signal of the temperature sensing unit 87 may be transmitted to a controller (not shown), and the controller may receive the output signal of the temperature sensing unit 87 and may determine whether the heater body 8311 is overheated and the temperature of the air flow F based on the output signal. When the overheating occurs, the controller may stop the operation of the heater body 8311 by cutting off the power supply to the heater body 8311.

In one example, a plurality of second bead forming portions 8322*b* that is convex in an upward direction may be formed on the upper surface 8322*a* of the upper housing 8322.

Due to the second bead forming portion 8321*b*, an isolation space may be formed between the first cover 881 disposed on top of the upper housing 8322 and the upper housing 8322 by a predefined spacing.

This isolation space may act as a thermally insulating air layer for the upper housing 8322, in a similar manner to the isolation space for the lower housing 8321 as described above.

In one example, with considering the fact that the heater body 8311 which generates high temperature heat is disposed in the housing composed of the lower housing 8321 and the upper housing 8322, each of the lower housing 8321 and the upper housing 8322 may be made of a metal plate resistant to high temperature heat and moisture. For example, each of the lower housing 8321 and the upper housing 8322 may be formed by pressing a plate made of a stainless steel-based material and having an approximately uniform thickness.

The moisture absorbent 85 absorbs moisture contained in the flow of air discharged from the tub 20 and inhaled by the device 80 when the sorption drying device 80 operates in the moisture-absorption mode. When the sorption drying device 80 operates in the moisture absorbent drying mode, the moisture absorbent 85 discharges the absorbed moisture into the air flow F.

In other words, the moisture absorbent 85 may be made of a reversibly dehydratable material so as to absorb the moisture or discharge the absorbed moisture depending on an operating temperature range.

The reversibly dehydratable material may include any one of aluminum oxide, silicon oxide, silica gel, alumina silica, or zeolite, or may be a composition having a combination of two or more selected therefrom.

In an example, the moisture absorbent 85 made of an alumina silica-based material including aluminum oxide and silicon oxide may be applied to the sorption drying device 80 according to the present disclosure. The present disclosure is not limited thereto. However, following descriptions will be based on an example in which the alumina silica-based moisture absorbent 85 is employed.

In this way, the moisture absorbent 85 made of the alumina silica-based material may be provided in a form of particles with a predefined particle size so that a contact area with the air flow F may be secured as much as possible. Moreover, compared to the moisture absorbent made of pure aluminum oxide or silicon oxide, a moisture-absorption action of the moisture absorbent 85 made of the alumina silica-based material may be effective at a lower temperature range, and regeneration action may be effective at a lower temperature range.

However, while the air flow F may flow through a gap between the plurality of moisture absorbents 85 provided in the form of particles, the air flow F may contact the moisture absorbents 85 such that the moisture contained therein is absorbed into the moisture absorbents 85 or the air flow absorbs the moisture discharged from the moisture absorbents 85.

Therefore, the moisture absorbent 85 cannot help but act as flow resistance to the air flow F. The particle size of the moisture absorbent 85 may be selected such that a pore may be effectively formed between the particles to minimize such flow resistance, and optimal moisture-absorption efficiency may be secured.

For this purpose, the moisture absorbent 85 may have the particle size in a range of 2 mm to 6 mm.

In one example, the moisture absorbent 85 is disposed downstream of the blower 82 and the heating unit 83 in the flow direction of the air flow F.

More specifically, the moisture absorbent 85 may be accommodated in the moisture absorbent receiving space S3 of the main housing 841 positioned downstream of the blower 82 and the heater 83.

The moisture absorbent receiving space S3 may be defined in the moisture absorbent receiving portion 8412 of the main housing 841 and may be defined by a pair of moisture absorbent holders 86 disposed to be spaced apart from each other along the vertical direction.

Figure 12:
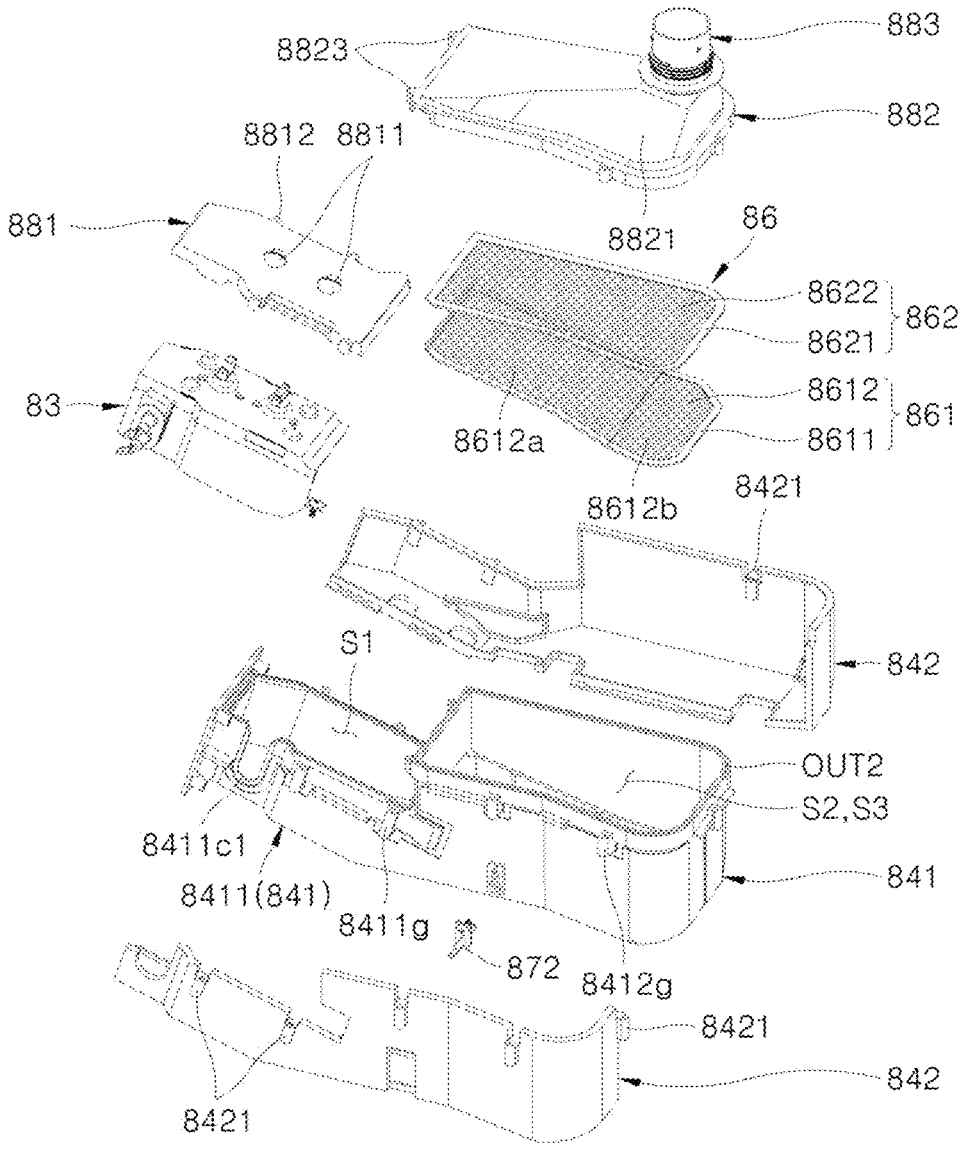
FIG. 12 is an exploded perspective view of FIG. 10 and FIG. 11.

As shown in FIG. 12, in one example, the pair of moisture absorbent holders 86 may be configured to include a first moisture absorbent holder 861 defining the lower end surface of the moisture absorbent receiving space S3 and dividing the inner space of the moisture absorbent receiving portion into the moisture absorbent receiving space S3 and the air introduction space S2, and a second moisture absorbent holder 862 defining a top surface of the moisture absorbent receiving space S3.

The first moisture absorbent holder 861 and the second moisture absorbent holder 862 may be formed in a plate shape so as to define the top surface and the lower end surface of the moisture absorbent receiving space S3, respectively.

More specifically, the first moisture absorbent holder 861 may be configured to include an outer edge 8611 to maintain overall strength thereof, and a mesh 8612 that is formed in an inner space defined by the outer edge 8611 and allows air to flow therethrough.

Likewise, the second moisture absorbent holder 862 may be configured to include an outer edge 8621 for maintaining overall strength thereof, and a mesh 8622 formed in an inner space defined by the outer edge 8621 and allows air to flow therethrough.

Thus, between the mesh 8612 of the first moisture absorbent holder 861 and the mesh 8622 of the second moisture absorbent holder 862, a second flow channel C2 through which the air flow F may pass may be formed.

In this regard, in order to prevent the moisture absorbent 85 from leaving out of the moisture absorbent receiving space S3, a grid size of each of the mesh 8612 of the first moisture absorbent holder 861 and the mesh 8622 of the second moisture absorbent 85 may be smaller than the particle size of the moisture absorbent 85.

In one example, the mesh 8622 of the second moisture absorbent holder 862 may extend approximately parallel to the bottom surface 8412*a* of the moisture absorbent receiving portion 8412. That is, the mesh 8622 of the moisture absorbent holder 862 may extend parallel to the bottom surface 8412*a* of the moisture absorbent receiving portion 8412, while the mesh 8612 of the first moisture absorbent holder 861 may extend so as to defined a predefined crossing angle with respect to the bottom surface 8412*a* of the moisture absorbent receiving portion 8412.

In more detail, the mesh 8612 of the first moisture absorbent holder 861 may include a first holding surface 8412*a* defining a second crossing angle (a2 in FIG. 17) relative to the bottom surface 8412*a* of the moisture absorbent receiving portion 8412, and a second holding surface 8612*b* defining a third crossing angle (a3 in FIG. 17) relative to the bottom surface 8412*a* of the moisture absorbent receiving portion 8412.

In this regard, each of the second crossing angle a2 may be in a range of 20 to 25 degrees in a similar manner to the first crossing angle a1.

In this regard, the third crossing angle a3 may be smaller than the second crossing angle a2.

That is, the mesh 8612 of the first moisture absorbent holder 861 may be constructed to have double inclined surfaces including the first holding surface 8612*a* and the second holding surface 8612*b*.

Therefore, due to the shape of the mesh 8612 of the first moisture absorbent holder 861, the mesh 8612 of the first moisture absorbent holder 861 may extend in an inclined manner such that a vertical distance therefrom to the bottom surface 8412*a* of the moisture absorbent receiving portion 8412 gradually decreases as the mesh 8612 extends in a direction away from the heater receiving portion 8411.

Due to the shapes and the arrangement of the first moisture absorbent holder 861 and the second moisture absorbent holder 862, a vertical dimension H1 of the second flow channel C2 defined in the moisture absorbent receiving space S3 gradually increases as the channel C2 extends away from the heater receiving portion 8411. Moreover, a vertical dimension H2 of the air introduction space S2 defined under the first moisture absorbent holder 861 gradually decreases as the space S2 extends away from the heater receiving portion 8411.

Details regarding the moisture absorbent receiving space S3 and the second flow channel C2 will be described later with reference to FIGS. 16 to 20.

In one example, the housing 84 of the sorption drying device 80 accommodates therein the above-described heating unit 83 and moisture absorbent 85, and may define therein the first flow channel C1 of the air flow F having passed through the heater body 8311 and the second flow channel C2 of the air flow F having passed through the moisture absorbent 85.

In one example, as shown in FIGS. 10 to 12, the housing 84 may be configured to include the main housing 841 having the heater receiving space S1 in which the heating unit 83 is accommodated and the moisture absorbent receiving space S3 in which the moisture absorbent 85 is accommodated defined therein, and the auxiliary housing 842 coupled to an outer peripheral surface of the main housing 841.

First, the main housing 841 may include the heater receiving portion 8411 in which the heater receiving space S1 is formed, and the moisture absorbent receiving portion 8412 in which the moisture absorbent receiving space S3 is formed.

As shown, based on a state in which the device 80 is disposed on the base 90, the upper surface 8411*a* of the heater receiving portion 8411 may be entirely open and the heater receiving portion 8411 may have a hollow box shape having an overall hexahedral shape.

In the illustrated embodiment, a configuration in which the heater receiving portion 8411 is integrally connected to the moisture absorbent receiving portion 8412 is shown. However, the present disclosure is not limited thereto, and as described later, a configuration in which the heater receiving portion 8411 and the moisture absorbent receiving portion 8412 of the main housing 841 are manufactured separately and connected directly or indirectly to each other may also be employed.

The heater housing 832 and the heater body 8311 may be inserted through the open upper surface 8411*a* of the heater receiving portion 8411.

More specifically, the lower housing 8321 of the heater housing 832 may be first inserted into the heater receiving space S1, and then the heater body 8311 may be assembled therewith. After the assembly between the lower housing 8321 and the heater body 8311 has been completed, the upper housing 8322 of the heater housing 832 may be assembled with the lower housing 8321.

In this regard, as described above, a plurality of bead grooves may be formed in the bottom surface 8411*b* of the heater receiving portion 8411 as a position corresponding to the plurality of first bead forming portions 8411*b*1 disposed in the lower surface 8321*e* of the lower housing 8321.

Each of the first bead forming portions may be partially inserted into a corresponding bead groove 8411*b*1. Thus, the isolation space with the predefined spacing may be formed between the bottom surface 8411*b* of the heater receiving portion 8411 of the main housing 841 and the lower surfaces 8321*e* of the lower housing 8321. This isolation space may act as a thermally insulating air layer for the lower housing 8321.

The open upper surface of the heater receiving portion 8411 may be closed by coupling the first cover 881 which will be described later thereto after the placement and the assembly of the heating unit 83 has been completed. For this purpose, a fastening boss 8411*g* may be integrally formed with the front surface 8411*c* and the rear surface 8411*d* of the heater receiving portion 8411 as a position corresponding to a fastening boss 8812 of the first cover 881.

The heater receiving space S1 having a shape corresponding to the shape of the heater housing 832 may be formed in an inner space of the hollow heater receiving portion 8411.

Figure 14:
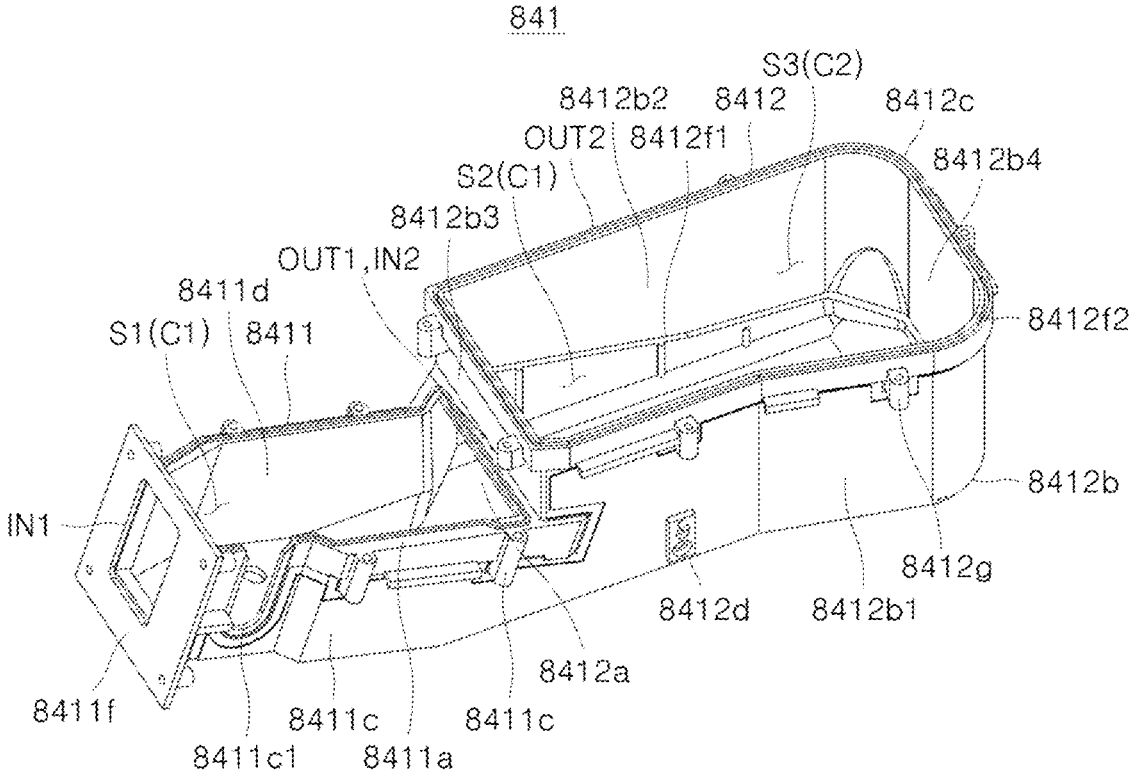
FIG. 14 and FIG. 15 are perspective and plan views of a main housing as shown in FIG. 12.

In more detail, as shown in FIG. 14, the heater receiving portion 8411 may extend linearly along a direction roughly parallel to the flow direction of the air flow F and the longitudinal direction of the heater body 8311 so as to accommodate an entirety of the heater body 8311 and the heater housing 832 therein. Accordingly, the heater receiving space S1 formed in an inner space of the heater receiving portion 8411 may extend linearly along the longitudinal direction of the heater receiving portion 8411.

In this regard, the length of each of the heater receiving portion 8411 and the heater receiving space S11 may be larger than the length of the heater housing 832, and a width of each of the heater receiving portion 8411 and the heater receiving space S1 may be greater than a width of the heater housing 832.

In one example, each of both opposing end surfaces along the longitudinal direction of the heater receiving portion 8411, that is, a front end surface formed at a right side surface 8411*f* and ta rear end surface formed at a left side surface is in an at least partially open state.

An open portion of the front end surface of the heater receiving portion 8411 may constitute the inlet IN1 through which the air flow F flows. An open portion of the rear end surface thereof may constitute the outlet OUT1 through which the air flow F having passed through the heater body 8311 is discharged out.

As described above, the discharge hole 8211 of the fan housing 821 may be inserted and coupled to the inlet IN1 formed in the right side surface 8411*f* of the heater receiving portion 8411. The right side surface 8411*f* of the heater receiving portion 8411 may be provided in a form of a flange surface extending outwardly from the inlet IN1 so as to serve as a coupling surface to which the heater racket 8314 is coupled.

In one example, the outlet OUT1 of the heater receiving portion 8411 may communicate with an inlet IN2 of the moisture absorbent receiving portion 8412. As in the illustrated embodiment, when the heater receiving portion 8411 and the moisture absorbent receiving portion 8412 are integrally connected with each other, the outlet OUT1 of the heater receiving portion 8411 and the inlet OUT1 of the moisture absorbent receiving portion 8412 IN2 may be integrated with each other, and the outlet OUT1 of the heater receiving portion 8411 may also serve as the inlet IN2 of the moisture absorbent receiving portion 8412.

In one example, the heater receiving portion 841 extends in a downward inclination such that which a vertical level thereof is gradually lowered as the flow channel formed by the heater receiving space S1 and the heater housing 832 extends toward the moisture absorbent receiving portion 8412.

That is, a center of the inlet IN1 of the heater receiving portion 8411 may be positioned at a higher position than that of a center of the outlet OUT1 thereof. The heater receiving space S1 and the heater housing 832 may extend in the longitudinal or extending direction in an inclined manner so as to have a downward inclination with respect to a horizontal direction.

This may be described based on the bottom surface 8412*a* of the moisture absorbent receiving portion 8412 as follows. The heater receiving portion 8411 may extend in a tilted manner so that the first crossing angle a1 is defined between the longitudinal direction of the heater receiving space S1 and the longitudinal direction of the bottom surface 8412*a* of the moisture absorbent receiving portion 8412. In the heater receiving space S1, the flow channel is substantially formed in the inner space of the heater housing 832, while the lower surface 8321*e* and the upper surface 8322*a* of the heater housing 832 are parallel to the bottom surface 8411*b* and the upper surface 8411*a* of the heater receiving portion 8411, respectively. Thus, hereinafter, following descriptions will be based on the heater receiving portion 8411.

As in the illustrated embodiment, when the bottom surface 8411*b* and the upper surface 8411*a* of the heater receiving portion 8411 extend parallel to the longitudinal direction of the heater receiving portion 8411, the first crossing angle a1 is formed between the bottom surface 8411*b* of the heater receiving portion 8411 and the bottom surface 8412*a* of the moisture absorbent receiving portion 8412.

For example, the first crossing angle a1 may be 45 degrees or smaller, preferably, in a range of 20 to 25 degrees.

In this way, while flowing through the heater receiving portion 8411, the flow direction of the air flow F changes so as to have an angle of 45 degrees or smaller. Thus, when the air flow F collides with the bottom surface 8412*a* of the moisture absorbent receiving portion 8412, a significant amount of the air flow F may be reflected therefrom after the collision and may flow toward the moisture absorbent 85 or in a discharge direction.

However, when the flow direction changes so as to have an angle greater than 45 degrees, the air flow F collides with the bottom surface 8412*a* of the moisture absorbent receiving portion 8412 and is reflected therefrom after the collision, and then a significant amount of the air flow F flows back toward the heater receiving space S1, resulting in decrease in flow efficiency.

Moreover, when the first crossing angle a1 has an angle of 45 degrees or greater, a space limitation due to a vertical dimension limitation of the base 90 may occur, and an entire length of the sorption drying device 80 extending across the tub 20 from the discharge hole of the sorption drying device 80 located at one side surface of the tub 20 to the inlet 811*a* located at the other side surface of the tub 20 is not satisfied. Therefore, an angle of 45 degrees or smaller may be an angle range selected by taking into account both the limitation of the arrangement of the sorption drying device 80 and the prevention of decrease in flow efficiency due to reverse air flow F.

Moreover, the heater receiving space S1 extends so as to define a small first crossing angle a1 of 25 degrees or smaller with respect to the bottom surface 8412*a* of the moisture absorbent receiving portion 8412. Thus, at a state in which the flow resistance of the flow F of the air introduced into the air introduction space S2 formed in an inner space of the moisture absorbent receiving portion 8412 through the heater receiving space S1 is minimized due to the bottom surface 8412*a* of the moisture absorbent receiving portion 8412, the flow direction thereof may be diverted.

Moreover, the moisture contained in the air flow F discharged from the tub 20 may be partially condensed in the inner space of each of the heater receiving portion 8411 and the moisture absorbent receiving portion 8412 before being absorbed by the moisture absorbent 85. The heater receiving portion 8411 extends in a downward inclination as it extends toward the moisture absorbent receiving portion 8412. That is, the heater receiving portion 8411 extends so as to have an upward inclination while the heater receiving portion 8411 extends in a direction away from the moisture absorbent receiving portion 8412. Thus, condensate generated when the moisture condenses may flow down by gravity and may be collected on the bottom surface 8412*a* of the moisture absorbent receiving portion 8412.

Therefore, the damage to the blower 82 and the heating unit 83 caused by the condensate may be minimized. For example, a situation in which the blower 82 and the heating unit 83 disposed at a relatively higher position than that of the bottom surface 8412*a* of the moisture absorbent receiving portion 8412 are immersed in the condensate may be prevented.

In one example, as described above, the front end of the heater housing 832 may include the expansion section in which the cross-sectional area of the flow path gradually increases along the front-to-back direction as it extends along the flow direction of the air flow F.

Correspondingly, the front end of the rear surface 8321*d* of heater housing 832 may include an inclined surface at a predefined inclination angle with respect to the flow direction so that the flow path cross-sectional area may increase as it extends in the flow direction of the air flow F.

In one example, the front surface 8411*c* of the heater receiving portion 8411 may have the fixing slot 8411*c*1 defined therein so that the terminal fixing portion 8313 of the heater body 8311 as described above may be fitted into the slot in a sliding manner.

In one example, based on the state in which the device 80 is disposed on the base 90, the moisture absorbent receiving portion 8412 and the heater receiving portion 8411 of the main housing 841 are arranged in a line such that the longitudinal direction of the moisture absorbent receiving portion 8412 and the longitudinal direction of the heater receiving portion 8411 are parallel to each other.

The moisture absorbent receiving portion 8412 may have an entirely open upper surface 8412*c*, and may have a generally hexahedral hollow box.

The open upper surface 8412*c* of the moisture absorbent receiving portion 8412 may function as the outlet OUT2 through which the air having passed through the moisture absorbent 85 is discharged out.

The open upper surface 8412*c* of the moisture absorbent receiving portion 8412 may be closed by combining a second cover 882 which will be described later thereto after the placement of the moisture absorbent holder 86 and the moisture absorbent 85 into the inner space of the moisture absorbent receiving portion 8412 has been completed.

For this purpose, a fastening boss 8412*g* may be integrally formed with each of a front surface 8412*b*1, a rear surface 8412*b*2, a right surface 8412*b*3 and a left surface 8412*b*4 of an outer peripheral surface 8412*b* of the moisture absorbent receiving portion 8412 as a position corresponding to each of fastening bosses 8823 of the second cover 882.

In more detail, as shown in FIG. 14 and FIG. 15, in one example, the moisture absorbent receiving portion 8412 may have a rectangular parallelepiped shape in which a width in a left and right direction between the left side surface 8412*b*4 and the right side surface 8412*b*3 is larger than each of a front-to-back width between the front surface 8412*b*1 and the rear surface 8412*b*2 and a vertical dimension between the upper space 8412*c* and the bottom surface 8412*a*. Therefore, like the heater receiving portion 8411, the moisture absorbent receiving portion 8412 may have the longitudinal direction as the left and right direction based on the illustrated drawing.

However, the left-right width and the front-to-back width of the moisture absorbent receiving portion 8412 may be larger than the left-right width and the front-to-back width of the heater receiving portion 8411, respectively. This is intended to secure a larger air introduction space S2 and a larger moisture absorbent receiving space S3 formed in an inner space of the moisture absorbent receiving portion 8412.

Moreover, the front-to-back width of the moisture absorbent receiving portion 8412 at a location adjacent to the left side surface 8412*b*4 may be larger than the front-to-back width of the moisture absorbent receiving portion 8412 at a location adjacent to the right side surface 8412*b*3. Preferably, an area whose a width in the front and rear direction increases as the area extends from the right side surface 8412*b*3 to the left side surface 8412*b*4 may be formed in the left side surface 8412*b*4.

As described above, the vertical dimension H2 of the air introduction space S2 formed under the first moisture absorbent holder 861 gradually decreases as the space S2 extends in a direction away from the heater receiving portion 8411, that is, extends toward the left side surface 8412*b*4.

A configuration that the front-to-back width of the left side surface 8412*b*4 is larger is intended be further increase a space on top thereof in order to cope with decrease in a volume of the air introduction space S2 caused because the left side surface 8412*b*4 of the air introduction space S2 has a lower vertical level than that of the right side surface of the air introduction space S2.

Moreover, as will be described later, the configuration that the front-to-back width of the left side surface 8412*b*4 is larger is intended to reduce the flow resistance of the air flow F such that the air flow F smoothly converges toward the outlet 8822 while the air flow F flows to the outlet 8822 of the second cover 882 which is close to the left side surface 8412*b*4.

Furthermore, as shown in FIG. 15, the maximum front-to-back width W1 of the heater receiving space S1 may be smaller than the minimum front-to-back width W2 of the air introduction space S2. Thus, the vertical dimension H2 of the air introduction space S2 gradually decreases as the space S2 extends away from the heater receiving portion 8411. However, the front-to-back width of the air introduction space S2 is larger than that of the heater receiving space S1, thereby effectively preventing the flow resistance from rapidly increasing in the air introduction space S2.

In this regard, the heater receiving portion 8411 may be located in an area in the front-to-back direction occupied by the moisture absorbent receiving portion 8412 based on the width direction perpendicular to the longitudinal direction of the heater receiving portion 8411, that is, in the front-to-back direction based on the illustrated drawing. That is, the moisture absorbent receiving portion 8412 may be positioned so that the heater receiving portion 8411 does not protrude forward or backward beyond the moisture absorbent receiving portion 8412.

In one example, the moisture absorbent receiving portion 8412 may be arranged in a line with the heater receiving portion 8411. In a top view, the moisture absorbent receiving portion 8412 and the heater receiving portion 8411 do no overlap each other. The moisture absorbent receiving portion 8412 and the heater receiving portion 8411 are spaced from each other so as to have portions having the same vertical level based on the bottom surface of the moisture absorbent receiving portion 8412 to minimize a vertical dimension of the main housing 841. The moisture absorbent receiving portion 8412 and the heater receiving portion 8411 are positioned such that the heater receiving portion 8411 does not protrude in the forward and backward directions beyond the moisture absorbent receiving portion 8412. Thus, the front-to-back width occupied by the sorption drying device 80 may be minimized. Accordingly, the space occupied by the sorption drying device 80 may be minimized, such that space utilization between the base 90 and the tub 20 may be improved.

In one example, the right side surface 8412*b*3 of the outer peripheral surface 8412*b* of the moisture absorbent receiving portion 8412 may be partially open to constitute the inlet IN2 into which the air having passed through the heater receiving portion 8411 flows. In this regard, the lower end of the inlet IN2 may extend to the bottom surface 8412*a* constituting an inner bottom surface and being flat, while the upper end of the inlet IN2 may be positioned at a lower vertical level than that of the upper surface 8412*c*.

Moreover, as described above, the inlet IN2 of the moisture absorbent receiving portion 8412 may be integrated with the outlet OUT1 of the heater receiving portion 8411.

The inner space of the moisture absorbent receiving portion 8412 may be divided into an upper space and a lower space via the first moisture absorbent holder 861.

The lower space under the first moisture absorbent holder 861 may act as the air introduction space S2 into which the air having passed through the heater receiving portion 8411 is introduced. The upper space above the first moisture absorbent holder 861 may act as the moisture absorbent receiving space S3 where the moisture absorbent 85 is accommodated.

A thermistor installation portion 8412*d* for fastening of the thermistor 872 as described above may be integrally formed with the front surface 8412*b*1 of the outer peripheral surface 8412*b* as a position corresponding to the air introduction space S2.

In one example, the heater receiving space S1 of the heater receiving portion 8411, and the air introduction space S2 and the moisture absorbent receiving space S3 of the moisture absorbent receiving portion 8412 constitute a continuous flow channel in which the air flow F flows. More specifically, the air introduction space S2 constitutes the downstream of the first flow channel C1, and the moisture absorbent receiving space S3 constitutes the second flow channel C2.

A first step 8412*f*1 and a second step 8412*f*2 may be formed on the inner surface of the outer peripheral surface 8412*b* to support the first moisture absorbent holder 861 and the second moisture absorbent holder 862.

As shown, the first step 8412*f*1 may protrude from the inner surfaces of the front surface 8412*b*1, the rear surface 8412*b*2 and the left side surface 8412*b*4 of the outer peripheral surface 8412*b* of the moisture absorbent receiving portion 8412 and between the bottom surface 8412*a* and the upper space 8412*c* of the moisture absorbent receiving portion 8412 so as to support the first moisture absorbent holder 861 in an area between the bottom surface 8412*a* and the upper space 8412*c* of the moisture absorbent receiving portion 8412. The first step 8412*f*1 may extend in a direction away from the inlet IN1 of the heater receiving portion 8411.

In this regard, the first step 8412*f*1 may extend to have two inclination angles corresponding to the second crossing angle a2 and the third crossing angle a3 of the first moisture absorbent holder 861.

In one example, a right end of the first step 8412*f*1 may be formed at a position close to the upper end of the inlet IN1 of the heater receiving portion 8411. More specifically, the right end of the first step 8412*f*1 may be formed at a lower position than that of the upper end of the inlet IN1 by a vertical dimension corresponding to a thickness of the outer edge 8611 of the first moisture absorbent holder 861.

Thus, a difference between vertical dimensions of the upper end of the inlet IN1 of the heater receiving portion 8411 and the lower end surface of the first moisture absorbent holder 861 may be minimized, and thus the flow loss may be minimized.

The second step 8412*f*2 may be formed so as to protrude from the inner surface of the outer peripheral surface 8412*b* of the moisture absorbent receiving portion 8412 and below the upper space 8412*c* of the moisture absorbent receiving portion 8412. In this case, in a corresponding manner to the arrangement structure of the second moisture absorbent holder 862, the second step 8412*f*2 may extend parallel to the upper space 8412*c* of the moisture absorbent receiving portion 8412.

Moreover, in a similar manner to the first moisture absorbent holder 861, the second step 8412*f*2 may be positioned at a lower position than that of the upper space 8412*c* of the moisture absorbent receiving portion 8412 by the vertical dimension corresponding to the thickness of the outer edge 8621 of the second moisture absorbent holder 862.

In one example, as shown in FIG. 15, the front end, that is, the right end of the bottom surface 8412*a* of the moisture absorbent receiving portion 8412 may extend beyond the inlet IN2 to an inner space of the heater receiving portion 8411.

Therefore, before flowing through the outlet OUT1 of the heater receiving space S1, that is, before flowing through the inlet IN2 of the moisture absorbent receiving portion 8412, the air flow F flowing in the inner space of the heater housing 832 may at least partially collide with the bottom surface 8412*a* of the moisture absorbent receiving portion 8412 and thus the flow direction thereof may begin to change.

As shown, the front end of the bottom surface 8412*a* of the moisture absorbent receiving portion 8412 extending to the heater receiving portion 8411 may have a concave coupling groove 8412*a*1 defined therein into which the horizontal extension of the heater bracket 8314 is coupled.

In one example, the auxiliary housing 842 may be coupled to the main housing 841 so as to at least partially surround the outer surface of the main housing 841, and serves to thermally insulate the inner space of the main housing 841 from the outside.

As shown, the auxiliary housing 842 may be disposed to surround an outer peripheral surface and an outer bottom surface of the main housing 841.

In this regard, a gap may be formed at least locally between an inner surface of the auxiliary housing 842 and the outer peripheral surface and the outer bottom surface of the main housing 841.

Due to this gap, a thermally insulating air layer may be formed between the auxiliary housing 842 and the main housing 841 in a similar manner to the thermally insulating air layer formed between the heater housing 832 and the heater receiving portion 8411 of the main housing 841 as described above.

Therefore, an amount of heat transfer from the inner space of the main housing 841 to the outside may be minimized. An internal temperature of the main housing 841 may be maintained in a temperature environment suitable for operation in the moisture-absorption mode or the moisture absorbent regeneration mode. Accordingly, power consumption may be minimized and the drying time of the washing target and the regeneration time of the moisture absorbent may be shortened.

The auxiliary housing 842 may be provided as divided structures arranged along the front and rear direction, as shown in FIG. 12 in consideration of case of manufacturing and assembly.

In one example, as described above, the open upper surface of the heater receiving portion 8411 of the main housing 841 and the open upper surface 8412*c* of the moisture absorbent receiving portion 8412 may be closed by the cover 88.

As shown by way of example, in consideration of the shape of the main housing 841, the cover 88 may be configured to include a first cover 881 coupled to the heater receiving portion 8411 and a second cover 882 coupled to the moisture absorbent receiving portion 8412.

The first cover 881 coupled to the heater receiving portion 8411 may be provided in a plate shape corresponding to the shape of the upper housing 8322 of the heater housing 832.

A pair of through holes 8811 may be formed in the first cover 881 to allow the aforementioned thermostat 871 to pass therethrough.

Moreover, a plurality of fastening bosses 8812 for fastening the main housing 841 and the auxiliary housing 842 to each other may be integrally formed with the outer edge of the first cover 881. A fastening means such as a screw bolt may extend through the fastening boss 8812, and may be screw-coupled to the fastening boss 8411*g* provided at the heater receiving portion 8411 of the main housing 841 or the fastening boss 8421 provided at the auxiliary housing 842.

In a similar manner to the thermally insulating air layer defined between the lower housing 8321 of the heater housing 832 and the heater receiving portion 8411 of the main housing 841, a thermally insulating air layer may be formed between the first cover 881 and the upper housing 8322.

In one example, unlike the first cover 881, the second cover 882 coupled to the moisture absorbent receiving portion 8412 may be formed to have a three-dimensional shape similar to an inverted funnel shape.

That is, the inner surface of the second cover 882 may be constructed to have an inverted funnel shape that is convex upwardly so that the air that has passed through the moisture absorbent 85 and the second moisture absorbent holder 862 as described above may converge.

Therefore, as the second cover 882 is provided with a converging surface 8821 that is convex upwardly, a predefined spacing S4 may be formed between the second moisture absorbent holder 862 which defines the top surface of the moisture absorbent receiving space S3, and the converging surface 8821 of the second cover 882. The spacing S4 may serve to minimize flow resistance that may occur locally depending on the flow resistance generated by the moisture absorbent 85 and the second moisture absorbent holder 862. As this spacing S4 is formed, a differential pressure distribution may be distributed evenly over an entire area between the upper and lower surfaces of the second moisture absorbent holder 862, and the air flow F having passed through the second moisture absorbent holder 862 may spread evenly. As the spacing S4 acts as a space along which the air flow F flows, the spacing S4 constitutes a discharge flow path through which the air flow F that has passed through the silver moisture absorbent 85 is discharged. Because the discharge flow path continuously communicates with the second flow channel C2 formed between the pair of moisture absorbent holders 86, the discharge flow path may be referred to as a third flow channel C3.

An upper end of the inner converging surface 8821 of the second cover 882 may have an outlet 8822 defined therein through which the air having passed through the third flow channel C3 as the discharge flow path is discharged.

In this regard, the outlet 8822 may be formed at a position as spaced as possible from the inlet IN2 of the moisture absorbent receiving portion 8412 in the horizontal direction or the longitudinal direction of the moisture absorbent receiving portion 8412. That is, based on the state as shown in the drawing, the outlet 8822 may be positioned closer to the left edge of the second cover 882 than to the right edge thereof.

As will be described later, a lower end of the connection duct 883 which guides the air flow F toward the lower surface 25 of the tub 20 may be integrally connected to the outlet 8822.

Moreover, like the first cover 881, a plurality of fastening bosses 8823 for fastening the main housing 841 and the auxiliary housing 842 to each other may be formed integrally with the outer edge of the second cover 882. The fastening means such as the screw bolt may extend through the fastening boss 8823, and may be screw-coupled to the fastening boss 8412*g* provided at the moisture absorbent receiving portion 8412 of the main housing 841 or the fastening boss 8421 provided at the auxiliary housing 842.

A detailed configuration of the second cover 882 related to the discharge flow path or the third flow channel C3 will be described later with reference to FIGS. 16 and 17.

In one example, the sorption drying device 80 may further include the connection duct 883 which is connected to the outlet passing through the upper surface of the second cover 882 and which has an air passage defined therein.

As described above, the heater 83, the blower 82, and the moisture absorbent 85 are disposed under the lower surface 25 of the tub 20. The connection duct 883 serves to guide the air flow F discharged from the spacing S4 formed under the second cover 882 toward the air supply hole 254 formed in the lower surface 25 of the tub 20.

As shown in the illustrated embodiment, a duct body 8831 of the connection duct 883 may be constructed to have a shape to connect the air supply hole 254 of the tub 20 and the outlet of the heater housing 832 to each other so as to guide the air flow F.

For example, as shown in FIG. 10 and FIG. 11, the duct body 8831 of the connection duct 883 may have a cylinder shape having a lower end in fluid communication with the outlet of the second cover 882, and an upper end extending in an upward direction (U-direction) and through the air supply hole 254.

In one example, as a means to improve fastening efficiency and prevent water leakage, a ring-shaped flange surface 8832 and a male screw member 8833 may be integrally formed with an outer peripheral surface of the duct body 8831.

The upper end of the duct body 8831 may extend upwardly (in the U-direction) through the lower surface 25 of the tub 20. The upper end of the duct body 8831 and the male screw member 8833 may at least partially extend through the lower surface 25 of the tub 20 and protrude toward the inner space of the tub 20.

A fastening nut (not shown) may be coupled to the male screw member 8833 extending through the inner space of the tub 20.

In fixing and fastening the duct body 8831, the upper end 8511 of the duct body 8831 may be fixed in an exposed state to the inner space of the tub 20 by screw-coupling the fastening nut to the male screw member 8833 in the inner space of the tub 20.

That is, in a state in which the fastening nut is in close contact with an upper side of the lower surface 25 of the tub 20, and the ring-shaped flange surface 8832 is in close contact with a lower side of the lower surface 25 of the tub 20, the flange surface 8832 may be pulled toward the lower surface 25 of the tub 20 under a coupling force of the fastening nut. Thus, the adhesion between the flange surface 8832 and the lower surface 25 of the tub 20 may be increased. Therefore, the possibility at which the washing water leaks to the outer peripheral surface of the duct body 8831 may be significantly reduced.

As a means to increase the effect of preventing the leakage of the washing water, an airtight ring (not shown) made of an elastic material may be additionally provided between the flange surface 8832 and the lower surface 25 of the tub 20.

In this way, when the upper end 8511 of the duct body 8831 is fixed to the tub 20 via the fastening nut, the left end of the heater housing 832 may be prevented from moving up and down (U-D direction) by the duct body 8831 and thus may be in a fixed state.

Thus, a support structure for an upper side of the sorption drying device 80 may be achieved without having additional fastening means.

The support structure for a lower side of the sorption drying device 80 may be achieved through a plurality of legs that protrude downwards from the bottom surface 8412*a* of the moisture absorbent receiving portion 8412 of the main housing 841.

In one example, the discharge guide 89 that changes the discharge direction of the air flow F supplied through the connection duct 883 may be coupled to the upper end of the duct body 8831.

Through the discharge guide 89, a portion of the air flow F may be directed toward the lower surface 25 of the tub 20, while a portion of the air flow F may be directed toward the upper surface 24 of the tub 20.

In one example, the sorption drying device 80 may further include the air intake duct 81 which has a front end connected to the air intake hole of the tub 20, and has a rear end connected to the blower 82, and that serves to guide the air flow F discharged from the tub 20 through the air supply hole 254 to the blower 82.

Figure 7:
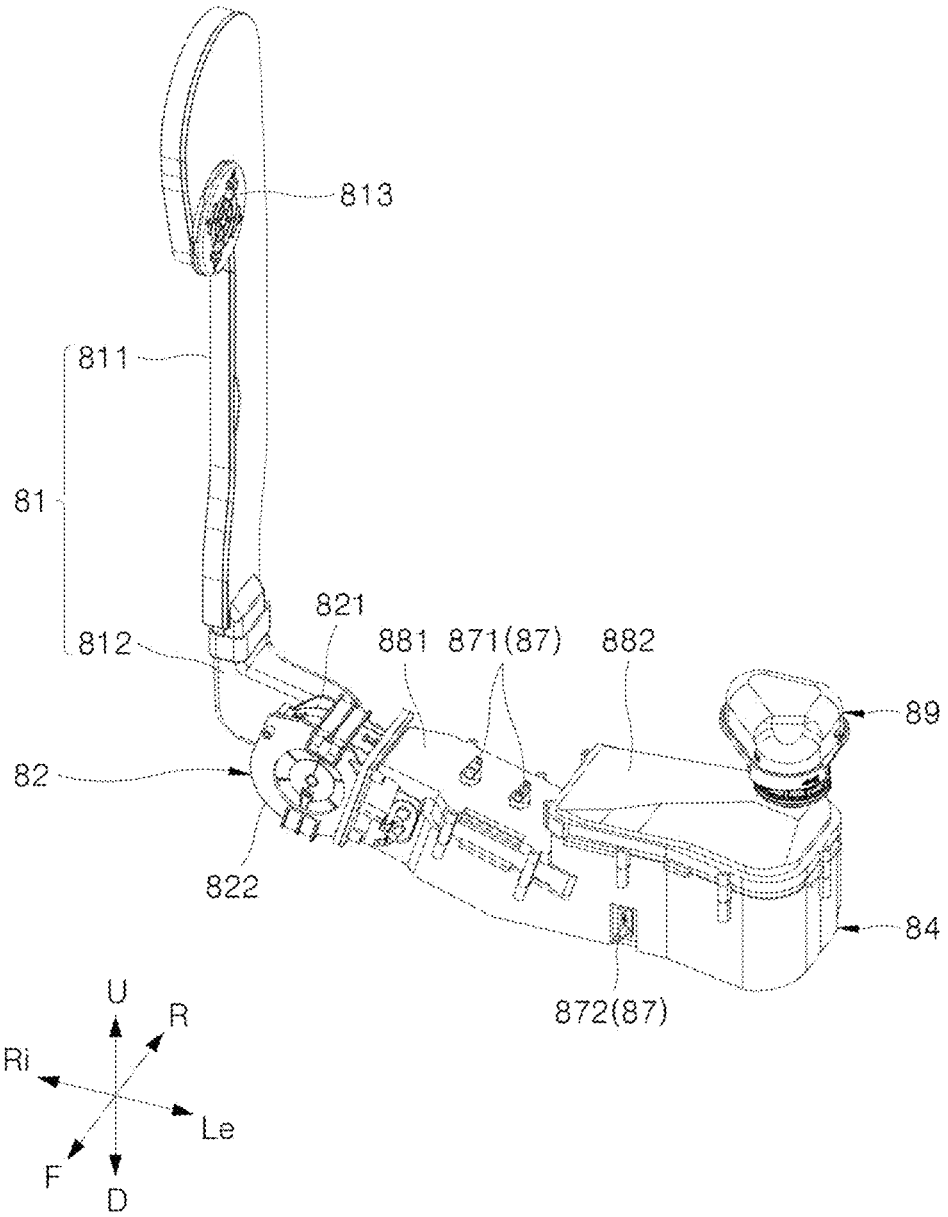
FIG. 7 is a front perspective view of a sorption drying device of a dishwasher according to an embodiment of the present disclosure.
Figure 8:
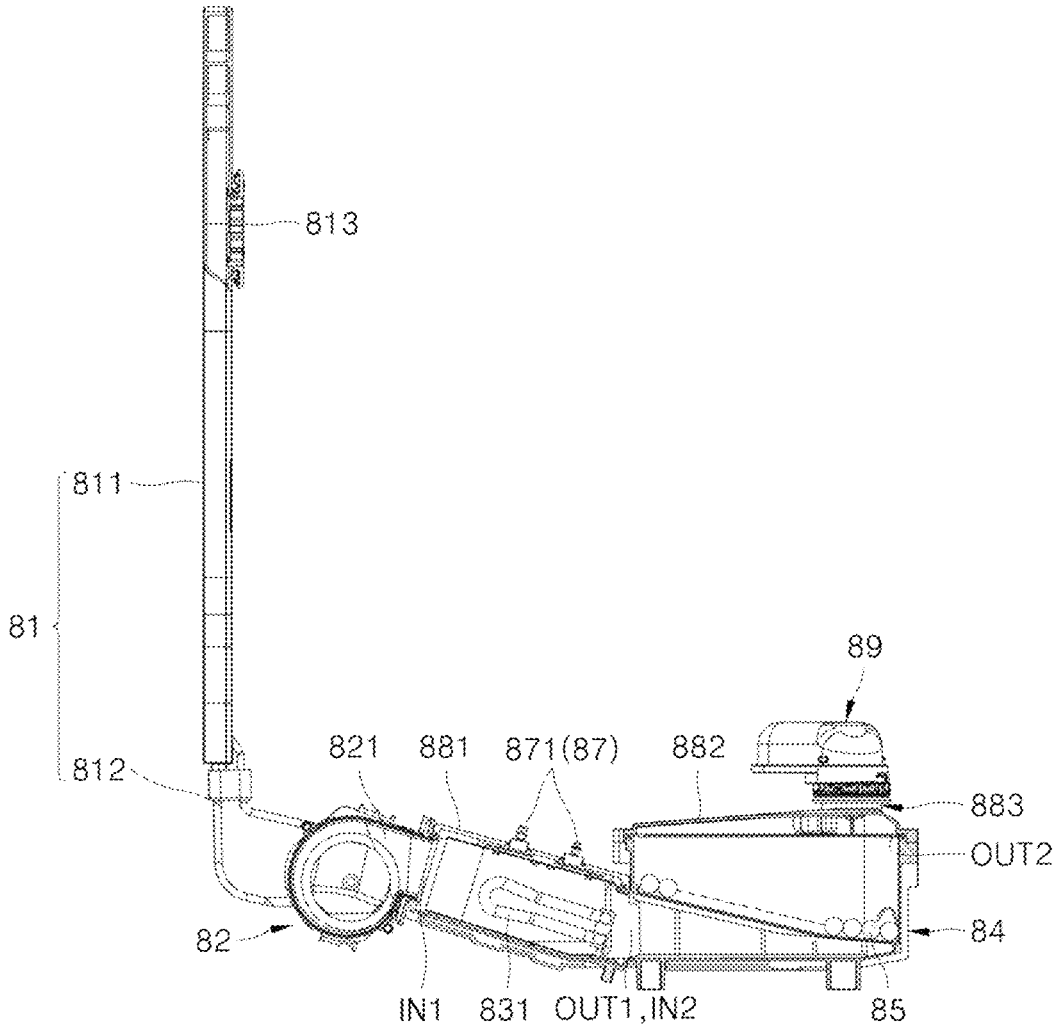
FIG. 8 is a cross-sectional view of the sorption drying device as shown in FIG. 7.

More specifically, as shown in FIGS. 7 to 9, the air intake duct 81 may be configured to include the main duct 811 extending along the vertical direction and disposed on an outside of the right side surface of the tub 20, and the auxiliary duct 812 located between the rear end of the main duct 811 and the blower 82 and under the lower surface 25 of the tub 20.

The main duct 811 may be disposed on the outside of the right side surface of the tub 20 and may be in close contact with the right side surface, and serves to guide the air flow F sucked through the air intake hole formed in the right side surface of the tub 20 to a position under the lower surface 25 of the tub 20.

To this end, as shown, the main duct 811 may be disposed so as to extend linearly as long as possible along the vertical direction between the upper end and the lower end. Thus, maximum condensation of moisture may occur inside the main duct 811.

As shown in FIG. 8, the inner space of the main duct 811 extends generally vertically. The air passage through which the air flow F flows in the downward direction may be formed in the inner space thereof. The air flow F may be introduced into the blower 82 through the auxiliary duct 812, which will be described later. The air flow F having passed through the blower 82 may be introduced into the heater receiving space S1 of the heater receiving portion 8411 having the downward inclination.

As described above, the heater receiving portion 8411 extends in a downward inclination of the first crossing angle a1 with respect to the bottom surface 8412*a* of the moisture absorbent receiving portion 8412. Therefore, the flow direction of the air flow F in the heater receiving space S1 may be changed so as to define an obtuse angle greater than 90 degrees with respect to the main duct 811.

Moreover, as the air flow F having passed through the heater receiving space S1 flows into the air introduction space S2 of the moisture absorbent receiving portion 8412, the flow direction thereof may be changed. In this case as well, the flow direction of the air flow F may be changed so as to define an obtuse angle greater than 90 degrees with respect to the flow direction of the heater receiving space S1.

The air flow F whose the flow direction has been changed in the heater receiving space S1 may be introduced into the moisture absorbent receiving space S3. Then, the flow direction thereof may be changed as the air flow flows into the connection duct 883 through the moisture absorbent 85. In this case as well, the flow direction of the air flow F may be changed so as to define an obtuse angle larger than 90 degrees while passing through the moisture absorbent 85 and flowing into the connection duct 883.

Therefore, the flow direction of the air flow F may be changed so as to define an obtuse angle larger than 90 degrees while the air follow flows along the main duct 811, the main housing 841, and the connection duct 883, such that the change in the flow direction of the air flow F so as to define the acute angle may be minimum, and flow resistance due to the flow direction change may be minimized. Accordingly, the power consumption to generate the air flow F may be minimized.

In this way, the main duct 811 may be manufactured in a hollow shape so that the air passage through which the air flow F may flow is formed therein.

In order to easily implement the hollow shape and for convenience of manufacturing, as shown in FIG. 9, in one example, the main duct 811 may be divided into the first duct body 8111 and the second duct body 8112, and each of the first duct body 8111 and the second duct body 8112 may be divided into segments along a vertical plane.

The first duct body 8111 may be formed in a shape of a hollow box with an open left side surface so that an inverted U-shaped air passage may be formed therein.

An inner space of the first duct body 8111 is maintained in a hollow state. Therefore, in the inner space of the first duct body 8111, a reinforcing rib 8113 extending along the extension direction of the air passage may be integrally disposed on the right side surface and may protrude from the right side surface to the left side surface.

In an example, the reinforcing rib 8113 may be positioned to divide the internal space of the first duct body 8111 to two spaces. Therefore, the reinforcing rib 8113 may play the role of dividing the air passage in the main duct 811 into two air passages.

Moreover, the reinforcing rib 8113 extends from the upper end of the inlet 811*a* formed in the second duct body 8112 to the outlet 811*b* of the main duct 811 along the air passage. Therefore, the reinforcing rib 8113 may also serve as a barrier that minimizes flow of the washing water flowing from the inlet 811*a* and scattering toward the outlet 811*b*.

The lower end of the first duct body 8111 may be open downwardly and this opening may constitute a portion of the outlet 811*b* through which the flow of air flows.

The second duct body 8112 is coupled to the open left side surface of the first duct body 8111 and serves to close the air passage formed in the first duct body 8111.

To this end, the second duct body 8112 may be provided in a plate shape corresponding to a shape of the open left side surface of the first duct body 8111.

An inlet 811*a* having a shape and size corresponding to those of the air intake hole of the tub 20 may be formed in the second duct body 8112. As described above, the grill cap 813 may be fastened to the inlet 811*a* to minimize the inflow of the washing water and prevent the inflow of foreign substances.

The lower end of the second duct body 8112 may be opened downwardly and this opening may constitute a remaining portion of the outlet 811*b* through which the flow of air flows.

The lower end of the first duct body 8111 and the lower end of the second duct body 8112 may be connected to each other to constitute the outlet 811*b* of the main duct 811, and may be connected to the auxiliary duct 812 so as to be inserted into the inlet of the auxiliary duct 812, which will be described later. An airtight ring 814 made of an elastic material may be disposed between an outlet 811*b* of the main duct 811 and an inlet 812*a* of the auxiliary duct 812.

The auxiliary duct 812 may be disposed between the lower end of the main duct 811 and the blower 82, and serves to change the flow direction of the air flow having passed through the outlet 811*b* of the main duct 811 toward to the blower 82.

Like the main duct 811, an air passage through which the air flow F having passed through the main duct 811 may flow may be formed in an inner space of the auxiliary duct 812.

However, in order to change the flow direction of the air having passed through the main duct 811 toward the inlet of the fan housing 821 of the blower 82, an air passage extending in an L shape may be formed in an inner space of the auxiliary duct 812.

Likewise, a shape of the auxiliary duct 812 may have an L-shape corresponding to the shape of the air passage defined therein.

The inlet 812*a* through which the flow of air is introduced may be formed at one end of the L-shape, that is, at an upper end thereof, based on the state shown in the drawing. The outlet 812*b* may be formed at one end of the L-shape, that is, at a lower end thereof, based on the state shown in the drawing.

The inlet 812*a* of the auxiliary duct 812 may have a rectangular cross-section shape corresponding to a shape of the outlet 811*b* of the main duct 811. The outlet 812*b* of the auxiliary duct 812 may have a circular shape corresponding to a shape of a circular inlet disposed in the other side surface of the fan housing 821.

In one example, a bridge 8123 as a fastening means for the fan housing 821 may be provided around the outlet 812*b* of the auxiliary duct 812.

In a manner similar to the bridge 8223 of the aforementioned connecting bracket 822, one end of the bridge 8123 of the auxiliary duct 812 may be fixed to the upper side of the outlet 812*b* of the auxiliary duct 812, while the other end thereof may extend in a bar shape to one side surface of the fan housing 821.

A fastening hole through which a fastening means such as a screw bolt passes may be defined in the other end of the bridge 8123 of the auxiliary duct 812. The fastening means may pass through the fastening hole and be fixed to one side surface of the fan housing 821.

Inner Flow Channel Structure of Main Housing

Hereinafter, with reference to FIGS. 16 to 20, flow channels formed in the inner space of the main housing 841 of the sorption drying device 80 according to an embodiment of the present disclosure and the flow direction of the air flow F flowing along the flow channels will be described.

As described above, the first flow channel C1, the second flow channel C2, and the third flow channel C3 through which the air flow F flows may be formed in the inner space of the main housing 841.

First, the first flow channel C1 may be divided into an upstream portion and a downstream portion around the outlet OUT1 of the heater receiving space S1 or the inlet IN2 of the moisture absorbent receiving space S3.

The upstream portion of the first flow channel C1 may be formed in an inner space of the heater receiving space S1 and in an inner space of the heater housing 832.

First, when the blower 82 operates, the air flow F having passed through the discharge hole 8211 of the fan housing 821 may flow into the inlet IN1 of the heater receiving space S1.

As the air flow F having passed through the inlet IN1 of the heater receiving space S1 is immediately introduced into the open front end of the heater housing 832, the air flow F flows along the inner air passage constituting the upstream portion of the first flow channel C1.

As shown, the flow direction of the air flow F introduced into the inner air passage is guided by the heater housing 832 so that the air flow F flows along a direction parallel to the longitudinal direction of the heater housing 832 and the longitudinal direction of the heater body 8311.

In one example, as described above, a section in which a width of the air passage gradually increases in the front-to-back direction while extending along the flow direction of the air flow F may be formed in the front end of the heater housing 832. In one example, such an expansion section may be formed in the rear surface 8321*d* of the heater housing 832 which defines the rear surface of the air passage.

Accordingly, the cross-sectional area size of the inner air passage of the heater housing 832 at the front end thereof may gradually increase. The air flow F introduced into the front end of heater housing 832 may have a gradual decrease in the flow rate thereof.

Figure 16:
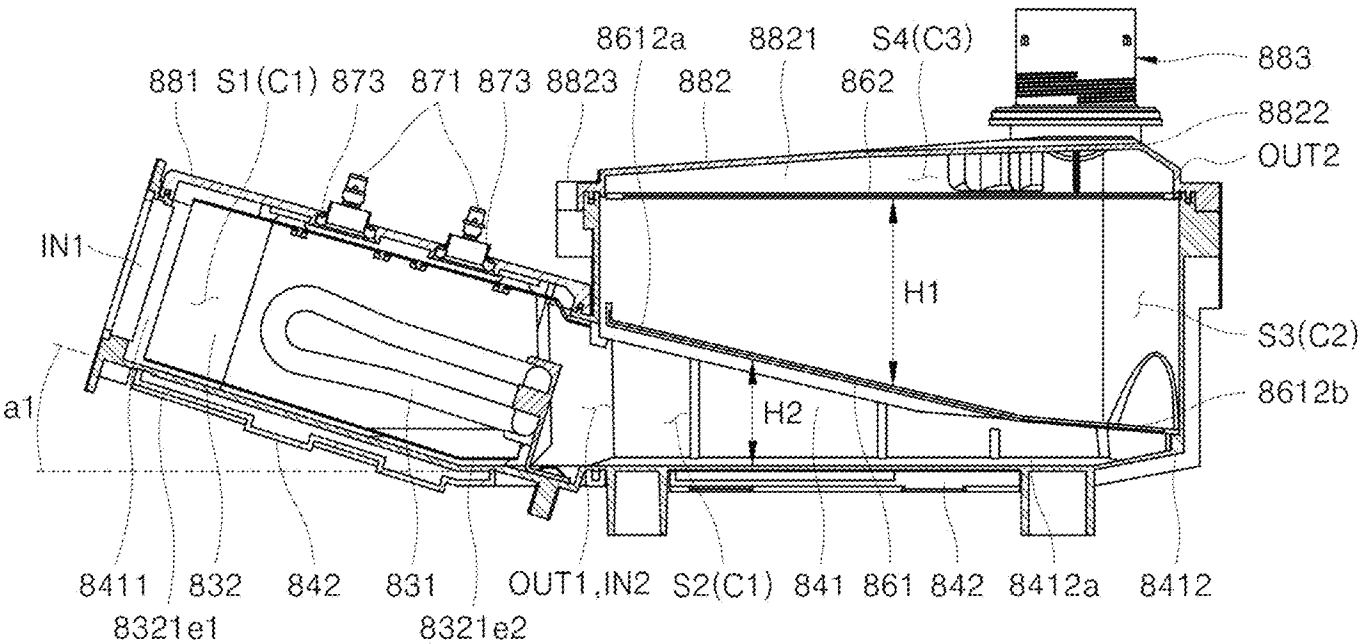
FIG. 16 is a cross-sectional view of FIG. 10.

However, as shown in FIG. 16, the expansion section may only extend to a position not beyond the front end of the heater body 8311. Moreover, a width between the upper surfaces 8322*a* of the heater housing 832 which defines the top surface of the flow channel and the first surfaces 8321*e*1 of the lower surface 8321*e* thereof which defines the lower end surface of the flow channel is maintained approximately constant.

Therefore, the cross-sectional area size of the flow channel is maintained approximately constant at a location where the heater body 8311 is accommodated. Thus, the flow rate of the air flow F may be maintained almost constant up to a position of the rear end of the first surface 8321*e*1.

In one example, as shown, the upper surface 8322*a* of the heater housing 832 and the first surface 8321*e*1 of the lower surface 8321*e* thereof may be parallel to each other, and may extend linearly along the longitudinal direction of the heater receiving portion 8411 so as to have a downward inclination while extending toward the inlet of the moisture absorbent receiving portion 8412.

Therefore, the upstream portion of the first flow channel C1 may extend linearly along the longitudinal direction of the heater receiving portion 8411 while extending in a downward inclination from the inlet IN1 of the heater receiving space S1 to the rear edge of the first surface 8321*e*1 of the heater housing 832.

In this regard, as described above, each of the upper surface 8322*a* of the heater housing 832 and the first surface 8321*e*1 of the lower surface 8321*e* thereof may extend so as to define the first crossing angle a1 with respect to the bottom surface 8412*a* of the moisture absorbent receiving portion 8412.

The upper surface 8322*a* of the heater housing 832 may extend linearly from the front end of the heater housing 832 to a position close to the upper end of the outlet OUT1 of the heater receiving portion 8411 while maintaining the first crossing angle a1 with respect to the bottom surface 8412*a* of the moisture absorbent receiving portion 8412. As described above, the first crossing angle a1 may be in a range of 20 to 25 degrees.

In one example, the extension direction of the bottom surface of the upstream portion of the first flow channel C1 may start to be changed at a position at which the second surface 8321*e*2 of the lower surface 8321*e* of the heater housing 832 is bent from the first surface 8321*e*1.

As shown, the location where the extension direction starts to change may be a location of the front end of the bottom surface 8412*a* of the moisture absorbent receiving portion 8412.

A remaining portion of a bottom surface of the first flow channel C1 after passing through the heater housing 832 is defined by the bottom surface 8412*a* of the moisture absorbent receiving portion 8412.

The bottom surface 8412*a* of the moisture absorbent receiving portion 8412 may extend linearly without changing the extension direction thereof from the front end formed in an inner space of the heater receiving portion 8411 to the rear end formed at the left side surface 8412*b*4 of the moisture absorbent receiving portion 8412. Therefore, the bottom surface of the first flow channel C1 defined between the front end and the rear end of the bottom surface 8412*a* of the moisture absorbent receiving portion 8412 may extend linearly without changing the extension direction thereof.

Therefore, the air flow F may be introduced into the air introduction space S2 which extends through the outlet OUT1 of the heater receiving space S1 so as to define the first crossing angle a1 of 25 degrees or smaller with respect to the bottom surface 8412*a* of the moisture absorbent receiving portion 8412 and then is formed in the moisture absorbent receiving portion 8412.

Therefore, the air introduced into the air introduction space S2 collides with the bottom surface 8412*a* of the moisture absorbent receiving portion 8412, such that the flow direction thereof may be effectively changed without a separate flow changing means in a state in which the flow resistance is minimized.

However, the air introduction space S2 extends in an elongate manner in a direction away from the inlet IN2 of the moisture absorbent receiving portion 8412. In this regard, as described above, the bottom surface of the downstream portion of the first flow channel C1 may extend along the direction away from the inlet IN2 by the bottom surface 8412*a* of the moisture absorbent receiving portion 8412.

Therefore, the flow rates and the pressures of the air flow F at a position adjacent to the inlet IN2 of the air introduction space S2 and at a position spaced far away from the inlet IN2 thereof may be different from each other.

To compensate for the pressure difference based on the position of the air flow F that may occur in the air introduction space S2, the air introduction space S2 of the sorption drying device 80 according to the present disclosure may be constructed such that the lower surface of the mesh 8612 of the first moisture absorbent holder 861 that defines the top surface of the air introduction space S2 has an inclined surface at a downward inclination as the lower surface extends away from the inlet IN2.

As shown, the mesh 8612 of the first moisture absorbent holder 861 may be constructed to have two inclined surfaces including the first holding surface 8612*a* that defines the second crossing angle a2 relative to the bottom surface 8412*a* of the moisture absorbent receiving portion 8412, and a second holding surface 8612*b* that defines the third crossing angle relative to the bottom surface 8412*a* of the moisture absorbent receiving portion 8412.

Thus, a vertical dimension H2 between the bottom surface of the air introduction space S2 and the top surface of the air introduction space S2 gradually decreases as the air introduction space S2 extends away from the inlet of the air introduction space S2.

Therefore, compared to a case where the mesh 8612 of the first moisture absorbent holder 861 is parallel to the bottom surface 8412*a* of the moisture absorbent receiving portion 8412, the variations in the pressure and the flow rate of the air flow F based on the distance from the inlet IN2 may be very small, and the pressure variation of the air flow F on the lower surface of the mesh 8612 of the first moisture absorbent holder 861 may be minimized.

Therefore, the flow rate of the air flow F flowing through the lower surface of the mesh 8612 of the first moisture absorbent holder 861 may be maintained approximately constant regardless of the distance from the inlet IN2. Accordingly, the flow rate of the air flow F flowing through the second flow channel C2 may be maintained approximately constant.

In one example, the second holding surface 8612*b* may be formed to define the third crossing angle a3 relative to the bottom surface 8412*a* of the moisture absorbent receiving portion 8412, such that a vertical dimension of a space furthest from the inlet IN2 in the horizontal direction and formed between the bottom surface 8412*a* and the left side surface 8412*b*4 of the moisture absorbent receiving portion 8412 and the left end of the first moisture absorbent holder 861 is maintained to a minimum value to prevent the air flow eddy.

Moreover, a vertical dimension between the second holding surface 8612*b* of the first moisture absorbent holder 861 and the second moisture absorbent holder 862 may be greater than a vertical dimension between the first holding surface 8612*a* of the first moisture absorbent holder 861 and the second moisture absorbent holder 862. In other words, a load of the moisture absorbent 85 acts more greatly on the second holding surface 8612*b* of the first moisture absorbent holder 861. As a structure to support the load of the moisture absorbent 85, as shown in FIG. 15, a support rib 8412*h* constructed to support the second holding surface 8612*b* of the first moisture absorbent holder 861 thereon may be disposed on an inner surface of the moisture absorbent receiving portion 8412 of the main housing 841. As shown, the support rib 8412*h* may be formed in a shape of a wall with a uniform thickness, and may extend along the longitudinal direction of the moisture absorbent receiving portion 8412 while being disposed under the area occupied by the second holding surface 8612*b*.

The second flow channel C2 may include the moisture absorbent receiving space S3 formed between the first moisture absorbent holder 861 and the second moisture absorbent holder 862.

In the second flow channel C2, the air flow F flows in a direction that is approximately perpendicular to the bottom surface 8412*a* of the moisture absorbent receiving portion 8412.

While the air flow F flows in the second flow channel C2, the moisture absorbent 85 may absorb the moisture from the air flow For the air flow F may absorb the moisture from the moisture absorbent 85, depending on the operation mode.

The air having passed through the second flow channel C2 flows along the third flow channel C3 formed in the spacing S4 formed between the second cover 882 and the second moisture absorbent holder 862.

As shown, the air flow F flowing along the third flow channel C3 may converge to the outlet 8822 formed at the upper end of the inner convergence surface 8821 of the second cover 882, and may pass through the outlet 8822 and into the lower end of the connection duct 883.

Because each of the cross-sectional area size of the flow path of the outlet 8822 and the cross-sectional area size of the flow path of the connection duct 883 is significantly smaller than the cross-sectional area size of the third flow channel C3, a flow rate of the air flow F having passed through outlet 8822 may be greatly increased.

Figure 18A:
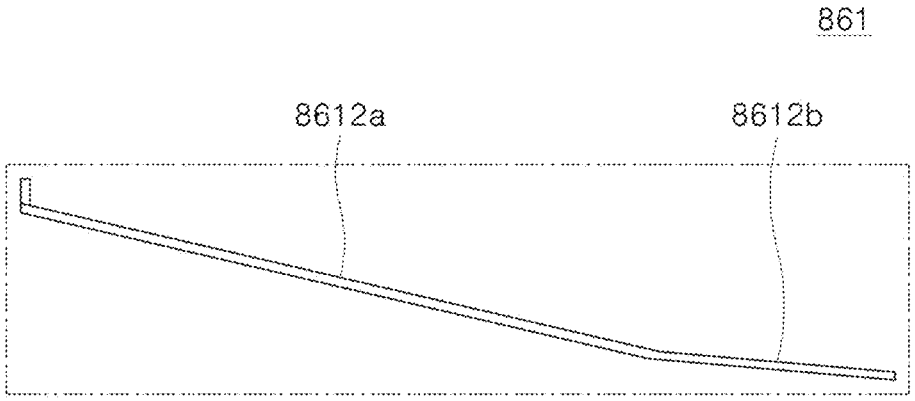
FIGS. 18A through 18C are a cross-sectional view showing various modifications of a first moisture absorbent holder as shown in FIG. 17.
Figure 18B:
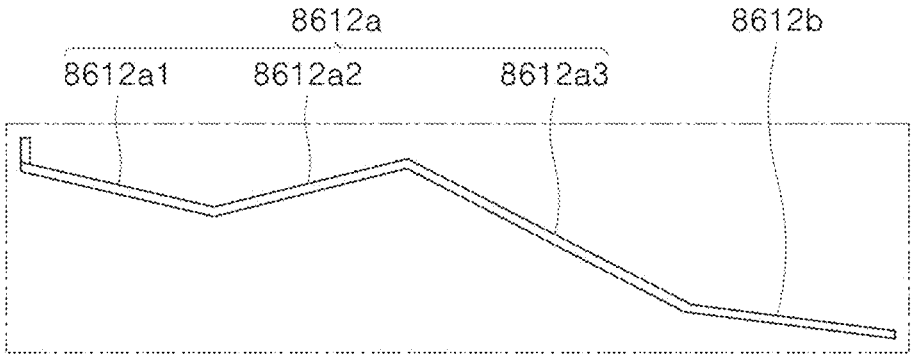
Figure 18C:
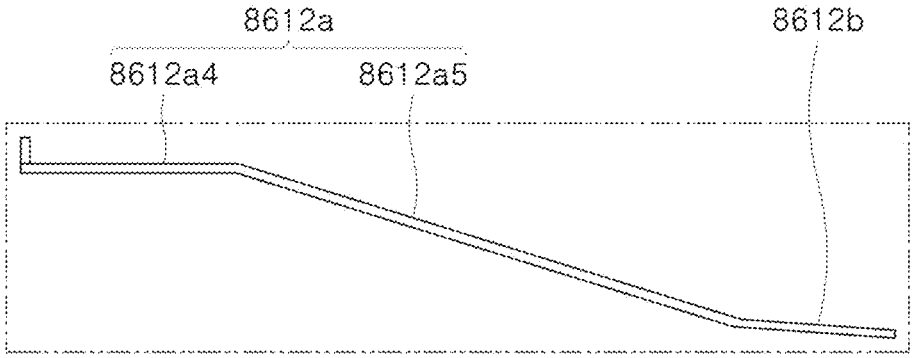

FIGS. 18A through 18C show some modifications of the first moisture absorbent holder 861 as described above.

As described above, the mesh 8612 of the first moisture absorbent holder 861 may include only a single first holding surface 8612*a* and a single second holding surface 8612*b* having the downward inclination angle maintained approximately constant with respect to the bottom surface of the moisture absorbent receiving portion 8412, as shown in (a) in FIGS. 18A through 18C. Alternatively, as shown in FIGS. 18B and 18C, the mesh 8612 of the first moisture absorbent holder 861 may include at least three holding surfaces having different extension angles or inclination angles.

First, as shown in FIG. 18B, the first holding surface 8612*a* of the first moisture absorbent holder 861 may be configured to include a first inclined surface 8612*a*1 having a downward inclination angle, a second inclined surface 8612*a*2 continuously extending from the first inclined surface 8612*a*1 and having an upward inclination angle, and a third inclined surface 8612*a*3 continuously extending from the second inclined surface 8612*a*2 and having a downward inclination angle.

In this way, the plurality of inclined surfaces including the first inclined surface 8612*a*1 with the downward inclination angle, the second inclined surface 8612*a*2 with the upward inclination angle, and the third inclined surface 8612*a*3 with the downward inclination angle are continuously arranged with each other, such that inflow angles of the air flow F from the air introduction space S2 into the plurality of inclined surfaces may be set to be different from each other. Therefore, the dispersion effect of the flow flowing through the first holding surface 8612*a* on the moisture absorbent 85 may be significantly improved.

In one example, as shown FIG. 18C, the first holding surface 8612*a* of the first moisture absorbent holder 861 may be composed of a parallel surface 8612*a*4 approximately parallel to the bottom surface of the moisture absorbent receiving portion 8412, and an inclined surface 8612*a*5 extending continuously from the parallel surface 8612*a*4 and having a downward inclination angle. The first moisture absorbent holder 861 as shown in FIG. 18C may have a lower flow dispersion effect compared to that in FIG. 18B, but may allow a lager holding capacity of the moisture absorbent 85 to be secured, compared to that in FIG. 18B. Therefore, the first moisture absorbent holder 861 as shown in FIG. 18C may be suitable for a case in which the moisture absorbent receiving space S3 with a larger volume is required.

In one example, FIGS. 19A through 19D show some modifications of a connection structure of the heater receiving portion 8411 and the moisture absorbent receiving portion 8412.

As described above, the heater receiving portion 8411 is not integrally connected to the moisture absorbent receiving portion 8412. Rather, the heater receiving portion 8411 and the moisture absorbent receiving portion 8412 may be manufactured separately and connected to each other directly or indirectly.

First, FIGS. 19A through 19D show a configuration in which the heater receiving portion 8411 is manufactured separately from the moisture absorbent receiving portion 8412, and is indirectly connected thereto.

A connector 8413 may be further provided as a means for indirectly connecting the heater receiving portion 8411 and the moisture absorbent receiving portion 8412 to each other.

The connector 8413 may be formed in a hollow shape to communicate the heater receiving portion 8411 and the moisture absorbent receiving portion 8412 functioning as an air passage with each other. A front end of the connecter 8413 in the flow direction of the air flow F may be connected to the outlet of the heater receiving portion 8411, while a rear end thereof in the flow direction of the air flow F may be connected to the inlet of the moisture absorbent receiving portion 8412.

In this regard, as shown, the extension direction of the connector 8413 may be set to vary based on an orientation of the heater receiving portion 8411.

Figure 19A:
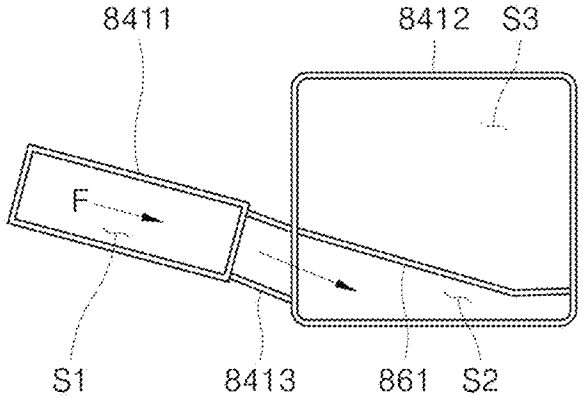
FIGS. 19A through 19D are a schematic cross-sectional view for illustrating various modifications in which a heater receiving portion and a moisture absorbent receiving portion constituting the main housing are manufactured separately and connected to each other.

More specifically, when the heater receiving portion 8411 extends in a downward inclination angle, the connector 8413 extends so as to have the same downward inclination angle as that of the heater receiving portion 8411, as shown in FIG. 19A. Alternatively, as shown in FIG. 19C, the connector 8413 may extend along a direction parallel to the bottom surface of the moisture absorbent receiving portion 8412.

Figure 19B:
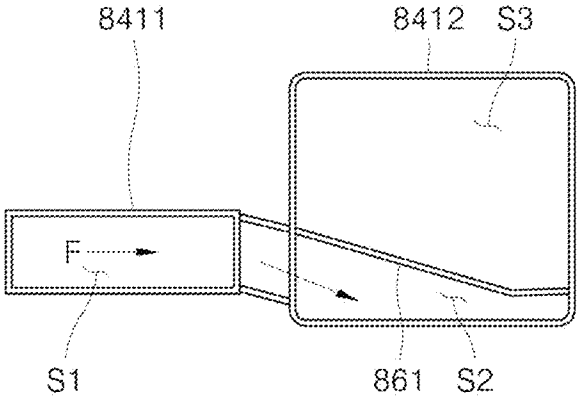
Figure 19C:
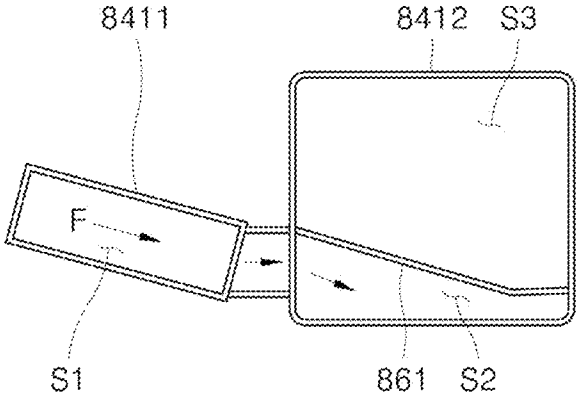

Alternatively, as shown in FIG. 19B, when the heater receiving portion 8411 extends along a direction parallel to the bottom surface of the moisture absorbent receiving portion 8412, the connector 8413 may extend so as to have a downward inclination angle to guide the air flow F having passed through the heater receiving portion 8411 toward the air introduction space S2.

Figure 19D:
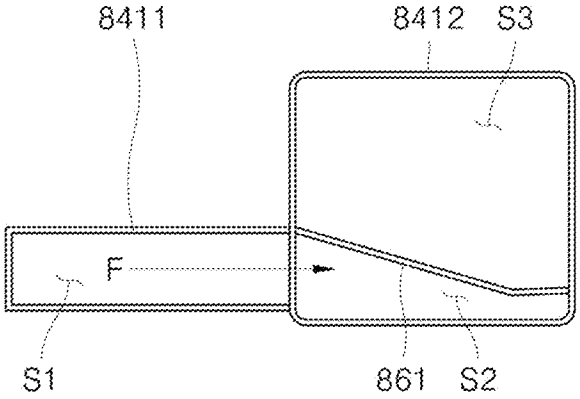

In one example, FIG. 19D shows a configuration in which the heater receiving portion 8411 is manufactured separately from the moisture absorbent receiving portion 8412, but is directly connected to the moisture absorbent receiving portion 8412.

As shown in FIG. 19D, the heater receiving portion 8411 may be constructed to extend in a direction parallel to the bottom surface of the moisture absorbent receiving portion 8412 and to be directly connected to the moisture absorbent receiving portion 8412 without the aforementioned connector 8413.

Although not shown, fastening means for fastening between the heater receiving portion 8411 and the moisture absorbent receiving portion 8412 may be disposed at each of the outlet side of the heater receiving portion 8411 and the inlet side of the moisture absorbent receiving portion 8412.

In this regard, because the heater receiving portion 8411 extends along a direction parallel to the bottom surface of the moisture absorbent receiving portion 8412, there is a possibility that liquid droplets generated by condensation in the inner space of the moisture absorbent receiving portion 8412 may flow into the heater receiving portion 8411.

In order to prevent such inflow of condensate droplets, the heater receiving portion 8411 may be connected to the moisture absorbent receiving portion 8412 such that the bottom surface of the heater receiving portion 8411 may be positioned at a higher level than that of the bottom surface of the moisture absorbent receiving portion 8412 in the vertical direction as shown in FIG. 19D.

Figure 17:
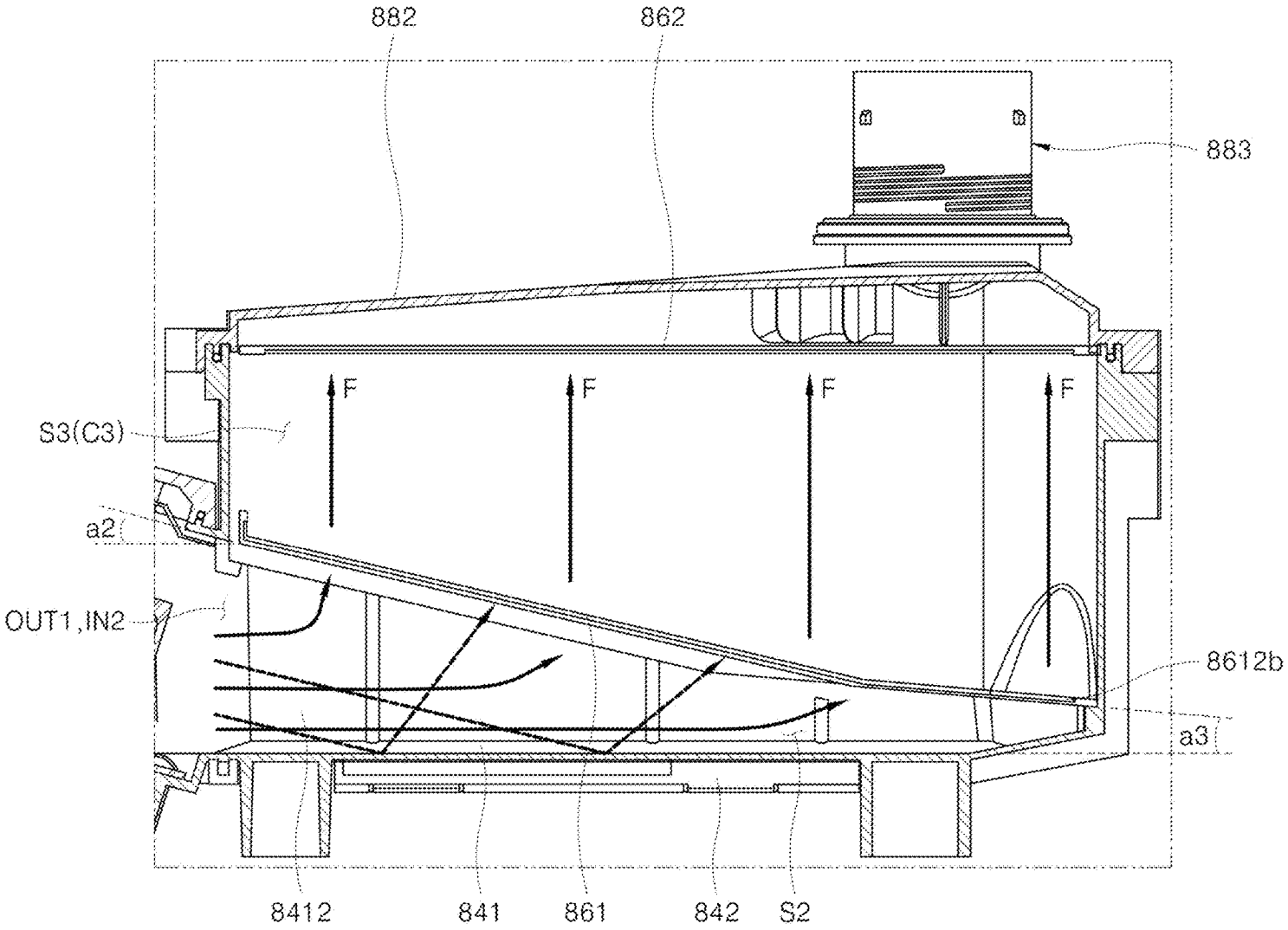
FIG. 17 is an enlarged view of a portion of FIG. 16.
Figure 20:
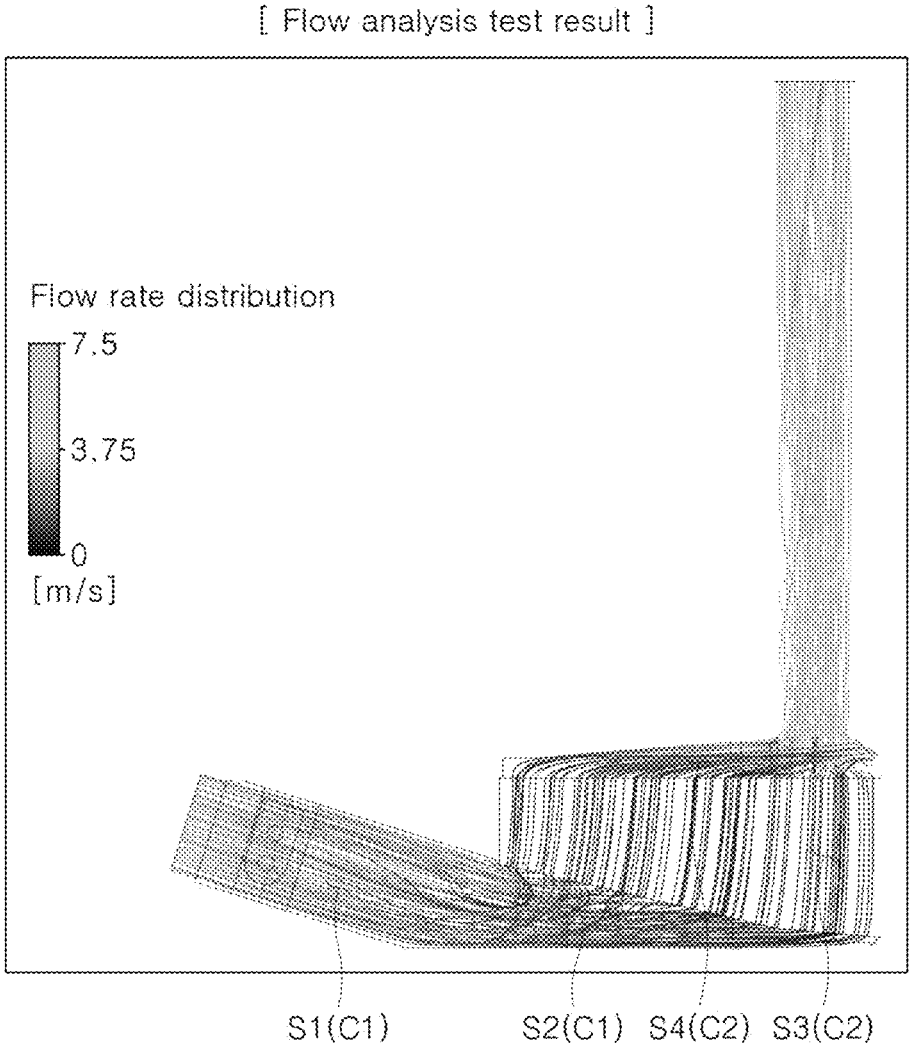
FIG. 20 is a diagram showing a result of a flow analysis test on a sorption drying device according to one embodiment of the present disclosure.

FIG. 20 shows a result of the flow analysis test according to the examples as shown in FIG. 16 and FIG. 17.

The result of the flow analysis test shows the flow rate distribution of the air flow F when an air flow amount of 0.33 CMM is introduced through the inlet IN1 of the heater receiving space S1.

As shown, the air flow F having passed through the inlet IN1 of the heater receiving space S1 flows linearly along the heater receiving space S1, and collides with the bottom surface 8412*a* of the moisture absorbent receiving portion 8412 at a location where the air flow F meets the bottom surface 8412*a*, such that the flow direction thereof may be changed to an upward direction.

A flow rate of the air flow F at the top surface of the air introduction space S2 has almost no deviation from the flow rate of the air flow F before passing through the first moisture absorbent holder 861. Accordingly, it may be identified that the air flow F having passed through the first moisture absorbent holder 861 flows in the third flow channel C3 in the uniform flow rate distribution.

Moreover, the spacing S4 is formed between the second cover 882 and the second moisture absorbent holder 862. Thus, it may be identified that the flow rate of the air flow F flowing through the second moisture absorbent holder 862 and the flow rate of the air flow F before flowing through the second moisture absorbent holder 862 are substantially equal to each other.

Although the embodiments of the present disclosure have been described in more detail with reference to the accompanying drawings, the present disclosure is not necessarily limited to these embodiments, and may be modified in a various manner within the scope of the technical spirit of the present disclosure. Accordingly, the embodiments as disclosed in the present disclosure are intended to describe rather than limit the technical idea of the present disclosure, and the scope of the technical idea of the present disclosure is not limited by these embodiments. Therefore, it should be understood that the embodiments described above are not restrictive but illustrative in all respects. In addition, even though an effect of a configuration of the present disclosure is not explicitly described in describing the embodiment of the present disclosure above, it is obvious that the predictable effect from the configuration should be recognized.

What is claimed is:

1. A dishwasher comprising:

a tub that defines a washing space configured to accommodate one or more objects to be washed; and a sorption drying device configured to absorb moisture from air discharged from the tub and to supply the air to the tub based on the moisture being absorbed, wherein the sorption drying device comprises:

a blow fan configured to generate air flow of the air, a moisture absorbent disposed downstream relative to the blow fan in a flow direction of the air flow, a heater disposed between the blow fan and the moisture absorbent in the flow direction of the air flow, the heater being configured to heat the air to be supplied to the moisture absorbent, a heater receiving portion that defines a heater receiving space accommodating the heater therein, the heater receiving portion having (i) a first inlet configured to receive the air having passed through the blow fan and (ii) a first outlet configured to discharge the air having passed through the heater, and a moisture absorbent receiving portion that defines a moisture absorbent receiving space accommodating the moisture absorbent therein, wherein the moisture absorbent receiving space is configured to receive the air having passed through the heater receiving portion, wherein the moisture absorbent receiving portion further defines an air introduction space disposed upstream relative to the moisture absorbent receiving space in the flow direction of the air flow, wherein the air introduction space is configured to receive the air having passed through the heater receiving space, wherein the heater receiving space extends toward the air introduction space, wherein the moisture absorbent receiving space has a second inlet configured to receive the air having passed through the first outlet and the air introduction space, and wherein a vertical width between a bottom surface of the air introduction space and a top surface of the air introduction space decreases as the air introduction space extends away from the second inlet.

2. The dishwasher of claim 1, wherein the heater receiving space and the air introduction space define a first flow channel configured to guide the air to the moisture absorbent, wherein the first outlet and the second inlet are fluidly connected to each other, wherein the heater receiving space extends along a downward inclination toward the bottom surface of the air introduction space, and wherein a vertical height of the heater receiving space from the bottom surface of the air introduction space decreases as the heater receiving space extends toward the first outlet.

3. The dishwasher of claim 2, wherein a first crossing angle defined between a bottom surface of the heater receiving space and the bottom surface of the air introduction space is equal to an angle defined between a top surface of the heater receiving space and the bottom surface of the air introduction space.

4. The dishwasher of claim 3, wherein the first crossing angle is less than or equal to 45 degrees.

5. The dishwasher of claim 1, wherein the sorption drying device further comprises a first moisture absorbent holder that is disposed in an inner space of the moisture absorbent receiving portion and divides the inner space of the moisture absorbent receiving portion into the moisture absorbent receiving space and the air introduction space, and wherein the first moisture absorbent holder has a lower surface that defines the top surface of the air introduction space.

6. The dishwasher of claim 5, wherein a first crossing angle is defined between a bottom surface of the heater receiving space and the bottom surface of the air introduction space, and wherein the first moisture absorbent holder has a first holding surface that defines a second crossing angle with respect to the bottom surface of the air introduction space.

7. The dishwasher of claim 6, wherein the second crossing angle is equal to the first crossing angle.

8. The dishwasher of claim 6, wherein the first moisture absorbent holder has a second holding surface that extends from the first holding surface and defines a third crossing angle with respect to the bottom surface of the air introduction space.

9. The dishwasher of claim 8, wherein the third crossing angle is less than the second crossing angle.

10. The dishwasher of claim 5, wherein the sorption drying device further comprises a second moisture absorbent holder disposed in the inner space of the moisture absorbent receiving portion and disposed above the first moisture absorbent holder, and wherein the moisture absorbent receiving space is defined between the first moisture absorbent holder and the second moisture absorbent holder.

11. The dishwasher of claim 10, wherein the second moisture absorbent holder is disposed parallel to the bottom surface of the air introduction space.

12. The dishwasher of claim 10, wherein the sorption drying device defines a second flow channel between the first moisture absorbent holder and the second moisture absorbent holder, the second flow channel being configured to receive the air from the air introduction space and to guide the air in a direction different from the flow direction in the air introduction space, and wherein a vertical width of the second flow channel increases as the second flow channel extends away from the second inlet.

13. The dishwasher of claim 1, wherein the heater receiving portion has (i) a first end connected to the blow fan and (ii) a second end connected to the moisture absorbent receiving portion, and wherein the heater is disposed between the first end and the second end of the heater receiving portion.

14. The dishwasher of claim 13, wherein at least a portion of the heater extends parallel to a longitudinal direction of the heater receiving space, the longitudinal direction connecting between a center of the first inlet and a center of the first outlet.

15. The dishwasher of claim 13, wherein the heater is disposed closer to the second end of the heater receiving portion than to the first end of the heater receiving portion.

16. The dishwasher of claim 13, wherein the sorption drying device further comprises a heater housing that defines the heater receiving space and accommodates the heater, the heater receiving space being an inner space of the heater housing.

17. The dishwasher of claim 16, wherein the heater housing is disposed in the heater receiving portion, and a longitudinal direction of the heater housing is parallel to a longitudinal direction of the heater receiving portion.

18. A dishwasher comprising:

a tub that defines a washing space configured to accommodate one or more objects to be washed; and a sorption drying device configured to absorb moisture from air discharged from the tub and to supply the air to the tub based on the moisture being absorbed, wherein the sorption drying device comprises:

a blow fan configured to generate air flow of the air, a moisture absorbent disposed downstream relative to the blow fan in a flow direction of the air, a heater disposed between the blow fan and the moisture absorbent in the flow direction of the air, the heater being configured to heat the air to be supplied to the moisture absorbent, a heater receiving portion that defines a heater receiving space accommodating the heater therein, wherein the heater receiving portion is configured to carry the air having passed through the blow fan, and a moisture absorbent receiving portion that defines a moisture absorbent receiving space accommodating the moisture absorbent therein, wherein the moisture absorbent receiving portion is configured to carry the air having passed through the heater receiving portion, wherein the heater and the moisture absorbent are spaced apart from each other in a horizontal direction, and wherein at least portions of the heater and the moisture absorbent are disposed at a same vertical level with respect to a bottom surface of the moisture absorbent receiving portion.

19. The dishwasher of claim 18, wherein a first crossing angle defined between a bottom surface of the heater receiving space and the bottom surface of the moisture absorbent receiving portion is equal to an angle defined between a top surface of the heater receiving space and the bottom surface of the moisture absorbent receiving portion.

20. A dishwasher comprising:

a tub that defines a washing space configured to accommodate one or more objects to be washed; and a sorption drying device configured to absorb moisture from air discharged from the tub and to supply the air to the tub based on the moisture being absorbed, wherein the sorption drying device comprises:

a blow fan configured to generate air flow of the air, a moisture absorbent disposed downstream relative to the blow fan in a flow direction of the air, a heater disposed between the blow fan and the moisture absorbent in the flow direction of the air, the heater being configured to heat the air to be supplied to the moisture absorbent, a heater receiving portion that defines a heater receiving space accommodating the heater therein, wherein the heater receiving portion is configured to carry the air having passed through the blow fan, and a moisture absorbent receiving portion that defines a moisture absorbent receiving space accommodating the moisture absorbent therein, wherein the moisture absorbent receiving portion is configured to carry the air having passed through the heater receiving portion, wherein the heater extends between the blow fan and the moisture absorbent such that the heater does not overlap the moisture absorbent along a vertical direction.

* * * * *